US009345981B1

(12) United States Patent
Lama

(10) Patent No.: US 9,345,981 B1
(45) Date of Patent: May 24, 2016

(54) MULTIDIMENSIONAL ALIGNMENT SPACING FOR TOY BUILDING ELEMENTS

(71) Applicant: Hasbro, Inc., Pawtucket, RI (US)

(72) Inventor: Salvatore F. Lama, Bolton, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 14/188,641

(22) Filed: Feb. 24, 2014

(51) Int. Cl.
*A63H 33/08* (2006.01)

(52) U.S. Cl.
CPC ..... *A63H 33/08* (2013.01)

(58) Field of Classification Search
USPC ..... 446/115, 116, 117, 120, 121, 124, 125, 446/128
See application file for complete search history.

(56) References Cited

U.S. PATENT DOCUMENTS

| | | | | |
|---|---|---|---|---|
| 3,005,282 | A * | 10/1961 | Christiansen | 446/128 |
| 3,716,939 | A * | 2/1973 | Pibet | 446/128 |
| 4,919,635 | A * | 4/1990 | Bertrand | 446/128 |
| 5,661,941 | A * | 9/1997 | Vataker | 52/604 |
| D394,465 | S | 5/1998 | Schmidt | |
| 5,795,210 | A | 8/1998 | Kushner | |
| 5,848,927 | A | 12/1998 | Frederiksen | |
| 6,102,766 | A * | 8/2000 | Leadbetter et al. | 446/128 |
| 6,554,676 | B1 * | 4/2003 | Bach | 446/116 |
| 6,645,033 | B1 * | 11/2003 | Thomsen | 446/120 |
| 7,347,028 | B1 * | 3/2008 | Bin-Nun et al. | 52/271 |
| D672,406 | S | 12/2012 | Sas | |
| D688,328 | S | 8/2013 | Holm | |
| D688,753 | S | 8/2013 | Holm | |
| D696,360 | S | 12/2013 | Holm | |
| 8,771,032 | B2 * | 7/2014 | Chang et al. | 446/124 |
| 8,905,812 | B2 * | 12/2014 | Pai-Chen | 446/122 |

FOREIGN PATENT DOCUMENTS

EM 001400857-0006 1/2014

OTHER PUBLICATIONS

"Slope Brick Curved 6×1," Lego Part No. 42022, photograph available at http://media.peeron.com/ldraw/images/47/3x/42022.png, downloaded on Jul. 29, 2014, 1 page.

Sets that have 'Slope Brick Curved 6×1' (42022), showing commercial availability of the 42022 part in various Lego (TM) sets in years 2002-2010, available at http://www.peeron.com/inv/parts/42022, downloaded on Jul. 29, 2014.

Brickset, Your Lego (TM) Set Guide, 4218749: Palisade Brick 1×2, showing production and commercial availability in at toy sets during years 2003-2014, available at http://brickset.com/parts/4218749, downloaded on Jul. 29, 2014, 3 pages.

Brickset, Your Lego (TM) Set Guide, 4523148: Palisade Brick 1×4, available at http://brickset.com/parts/4523148, downloaded on Jul. 29, 2014.

(Continued)

*Primary Examiner* — Kurt Fernstrom
(74) *Attorney, Agent, or Firm* — DiBerardino McGovern IP Group LLC

(57) ABSTRACT

Special multidimensional spacing for building elements of a toy construction system are described herein. Various coupling elements and configurations are described providing combinations of building elements in standard and offset alignments. In addition, special building elements provide various multidimensional alignments between standard building elements.

32 Claims, 20 Drawing Sheets

(56) References Cited

OTHER PUBLICATIONS

Brickset, Your Lego (TM) Set Guide, 4129996: Roof Tile 1×2×3/73 (degrees), showing production and commercial availability in toy sets during years 2000-2008, available at http://brickset.com/parts/4129996, downloaded on Jul. 29, 2014, 3 pages.

Brickset, Your Lego (TM) Set Guide, 4159279: Roof Tile 1×2×2, showing production in years 2001-2014, available at http://brickset.com/parts/4159279, downloaded on Jul. 29, 2014, 2 pages.

Kre-O Create It: CityVille Invasion, Part K101320 in Capture Cruiser Set A4910, Feb. 22, 2013, downloaded from http://www2.hasbro.com/common/documents/6d0a17b55056900b100f781b9c2c69e3/AB02BBD750569047F57D6BF49EBD31D6.pdf, downloaded on Oct. 18, 2015, 1 page.

* cited by examiner 418
400
416
414
417
415
z
x
1001

418
417
418
y
x
1001

1001
400
x
z 1001
x
z
400

MULTIDIMENSIONAL ALIGNMENT SPACING FOR TOY BUILDING ELEMENTS

TECHNICAL FIELD

The disclosed subject matter relates to combinable toy building elements and toy construction sets including the building elements.

BACKGROUND

Children and adults enjoy interacting with and collecting toys. Toys that may be assembled, disassembled, reassembled, and reconfigured are historically popular and educational. These toys help develop hand-eye coordination, fine motor skills, and stimulate creativity while providing endless hours of enjoyment and entertainment for children and adults alike.

In particular, construction toys that include interlocking and connecting plastic building elements promote creative and imaginative play by end users. Typically, plastic building elements attach to each other or interlock using an array of small cylindrical bumps or "studs" on the surface of one building element that fit into an array of holes or recesses on the surface of another building element. In general, the size and spacing of the studs and holes are standardized to enable attachment among various types of building elements and accessories that can be included in one or more construction toy kits.

A construction toy kit can include a standard set of pieces that allow end users to design and create a variety of different constructs in addition to specialized pieces. A construction toy kit also may provide instructions for using certain pieces to build a particular construct. In some cases, construction toy kits can be associated with particular themes for assembling constructs representing historical, contemporary, futuristic, or fictional objects, structures, vehicles, and creatures.

SUMMARY

In one general aspect, special multidimensional spacing of building elements in a toy construction system are provided for combinations of building elements in both standard and offset alignments. In addition, special building elements provide various multidimensional alignments between standard building elements.

In another general aspect, a building element of a toy construction system includes a first wall positioned in a first plane having an inner and outer surface; a perimeter wall extending orthogonally from the first wall; a cavity defined by the combination of the first wall and the perimeter wall; a plurality of male coupling elements of a coupling size extending from the outer surface of the first wall, the male coupling elements arranged in a 1 building unit (BU) grid on the outer surface; and a plurality of female coupling elements of the coupling size arranged in the cavity in a fractional BU grid, the fractional BU grid positioning a number of the plurality of female coupling elements to receive multiple male coupling elements of another building element in alignment with the 1 BU grid of the plurality of male coupling elements and positioning a number of the plurality of female coupling elements to receive multiple male coupling elements of another building element in a fractional alignment offset from the 1 BU grid of the plurality of male coupling elements in a single dimension of the first plane.

The fractional BU grid may position a number of the plurality of female coupling elements to receive multiple male coupling elements of another building element in a fractional alignment offset from the 1 BU grid of the plurality of male coupling elements in a single dimension of the first plane in either of a first dimension of the plane or a second dimension of the plane.

The fractional BU grid also may position a number of the plurality of female coupling elements to receive multiple male coupling elements of another building element in a fractional alignment offset from the 1 BU grid of the plurality of male coupling elements in a single dimension of the first plane in either of a first dimension of the plane or a second dimension of the plane and simultaneously in both the first and the second dimensions of the first plane.

The fractional BU grid may be a ½ BU grid.

The arrangement of the plurality of female coupling elements of the coupling size in the cavity in the fractional BU grid may include an arrangement of the female coupling elements in at least one row and a plurality of columns, the row and the columns ½ BU wide, and the row and the columns arranged corresponding to one of the first and the second dimensions of the plane.

The arrangement of the plurality of female coupling elements of the coupling size in the cavity in the fractional BU grid also may include an arrangement of the female coupling elements in a plurality of rows and a plurality of columns, the row and the columns ½ BU wide, the rows and the columns arranged corresponding to one of the first and the second dimensions of the plane.

The plurality of female coupling elements may include at least one grid element providing a point of clutch in the plurality of female coupling element. The grid elements may be arranged in the cavity according to an alignment grid in which the grid elements are positioned according to the intersections of the grid alignment lines defining the alignment grid. In one example, the lines of the grid alignment are ½ BU apart in both dimensions of the first plane.

The grid elements may include at least one of a rib element, a post, and an end portion of a wall.

The female coupling element may include a rib element formed on an interior side of the perimeter wall providing a point of clutch for a male coupling element received by the female coupling element.

At least one female coupling element of the plurality of female coupling elements may include a plurality of rib elements formed on at least two interior sides of the perimeter wall, each rib element providing a point of clutch for a male coupling element received by the corresponding at least on female coupling element.

At least one female coupling element of the plurality of female coupling elements also may include a post extending orthogonally from an interior side of the first wall into the cavity, the post providing a point of clutch for a male coupling element received by the corresponding at least on female coupling element.

At least one female coupling element of the plurality of female coupling elements also may include four posts extending orthogonally from an interior side of the first wall into the cavity, each post providing a point of clutch for a male coupling element received by the corresponding at least on female coupling element.

At least one female coupling element of the plurality of female coupling elements also may include an end portion of a wall providing a point of clutch for a male coupling element received by the corresponding at least on female coupling element.

The male coupling element may be a cylindrical stud.

The building element also may include another male coupling element of the coupling size extending from the outer surface of the first wall elements arranged according to a fractional BU grid on the outer surface, wherein the another male coupling element is fractionally offset in at least a single dimension of the first plane.

In another general aspect, a toy building set includes a set of building elements, at least a plurality of the building elements including male coupling elements of a coupling size and female coupling elements of the coupling size, the male and female coupling elements arranged in a standard 1 building unit (BU) grid; and an adapter building element including: a plurality of male coupling elements of the coupling size extending from an outer surface of the adapter building element, the male coupling elements arranged in a 1 BU grid on a plane the outer surface; and a plurality of female coupling elements of the coupling size arranged in the building element in a fractional BU grid, the fractional BU grid positioning one or more of the plurality of female coupling elements to receive male coupling elements of another building element in alignment with the 1 BU grid of the plurality of male coupling elements and positioning one or more of the plurality of female coupling elements to receive male coupling elements of another building element in a fractional alignment offset from the 1 BU grid of the plurality of male coupling elements in a single dimension corresponding to the plane of the outer surface.

The adapter building element when coupled to one or more female coupling elements of a first one of the plurality of building elements and simultaneously coupled to one or male coupling of a second one of the plurality of building elements may offset the 1BU grid of the first one of the plurality of building elements from the 1BU grid of the second one of the plurality of building elements by a fraction of a BU in a single dimension corresponding to the plane of the outer surface of the adapter building element.

The 1BU grid may be an arrangement of the plurality of male coupling elements in one or more rows and columns parallel to the first and second dimensions of the first plane where the centers of any two adjacent male coupling elements of the arrangement in any one dimension are 1BU apart. In addition, 1BU may be the base distance between the centers of any two adjacent male coupling elements of the plurality of male coupling elements in a row or column.

In yet another general aspect, a toy building set comprising a plurality of toy building elements, wherein the plurality of toy building elements comprise an adapter building element comprising: a first wall positioned in a first plane having an inner and outer surface; a perimeter wall extending orthogonally from the first wall; a cavity defined by the combination of the first wall and the perimeter wall; a plurality of male coupling elements of a first coupling size extending from the outer surface of the first wall, the male coupling elements arranged in a 1 building unit (BU) grid on the outer surface; and a plurality of female coupling elements of the first coupling size arranged in the cavity in a fractional BU grid, the fractional BU grid positioning a number of the plurality of female coupling elements to receive multiple male coupling elements of another building element in alignment with the 1 BU grid of the plurality of male coupling elements and positioning a number of the plurality of female coupling elements to receive multiple male coupling elements of another building element in a fractional alignment offset from the 1 BU grid of the plurality of male coupling elements in a single dimension of the first plane.

Other features will be apparent from the description, the drawings, and the claims.

DETAILED DESCRIPTION

Figure 1A:
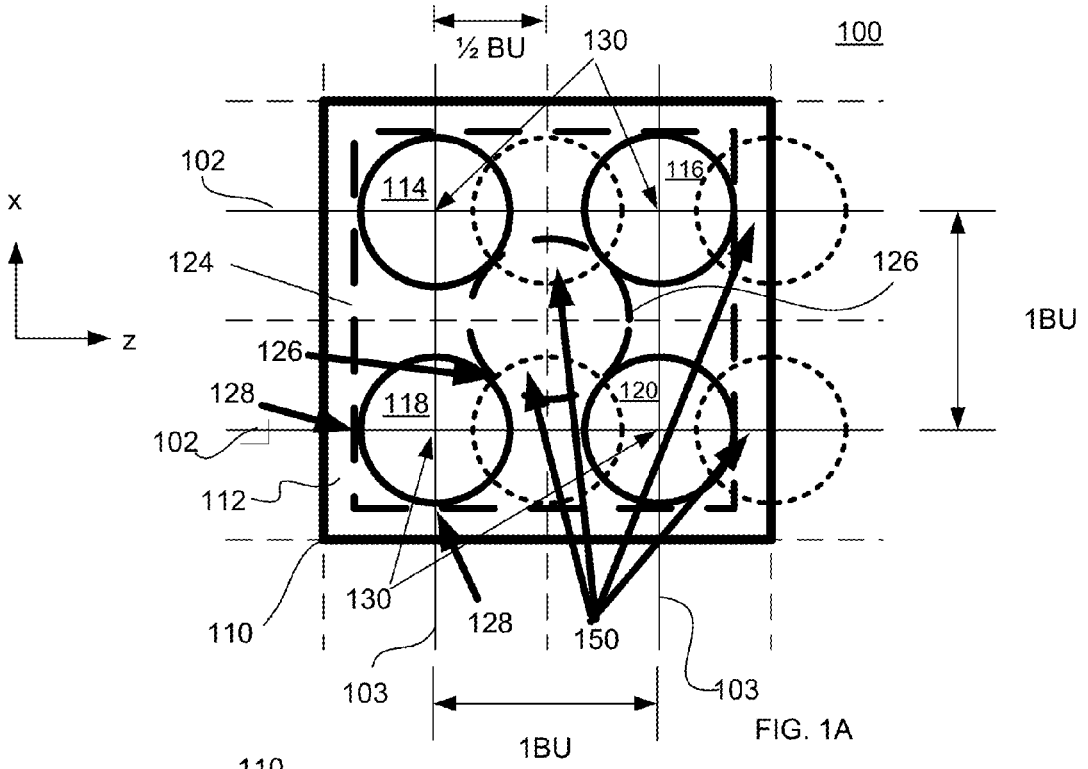
FIG. 1A illustrates an example of a spatial relationship in building units of a toy building element.

Toy construction sets include a number of building elements (for example, parts, pieces, and/or accessories), that may be assembled, disassembled, reassembled, and reconfigured countless times and in different configurations to provide hours of enjoyment, entertainment, and creative stimulation. Special multidimensional alignment for building elements of a toy construction system is described herein. Various coupling elements and configurations are described providing combinations of building elements in standard and offset alignments. In addition, special building elements provide various multidimensional alignments between standard building elements.

In general, toy construction sets, and their elements, are designed and manufactured to have dimensions that correspond to certain dimensions of one or more standard building elements, studs, coupling sizes, and/or accessories included in the toy construction kits or sets, (such as bricks, plates, and specialized build elements and accessories). For instance, a standard building element such as a 1×1 plate may have a length of 7.80 mm, a width of 7.80 mm, and a height of 3.20 mm (not including the stud), and a standard building element such as a 1×1 brick may have a length of 7.80 mm, a width of 7.80 mm, and a height of 9.60 mm (not including the stud). In this example, three 1×1 plates can be coupled together to have substantially the same dimensions as a 1×1 brick.

Building elements may include one or more coupling elements. Coupling elements of standard building elements include male coupling elements, for example, in the form of a coupling stud, and female coupling elements, for example, in the form of a coupling recess that is sized to receive the coupling stud. The male and female coupling elements can have a first coupling size. For example, the first coupling size of a standard coupling stud (that is on a surface of a building element, such as a plate or brick) is defined by an outside diameter of 4.88 mm and a height of 1.80 mm, and the coupling recesses are sized to have an interference fit with the coupling studs of the same size. There can be different types and configurations of female recesses that mate with the first coupling size. For example, in some configurations, the recesses may be circular, partially circular with flats on multiple sides, square, or pronged to name a few. The recesses may have varying depths; however, a minimum depth may be provided to ensure proper coupling with the male stud via an interference fit. Additional configurations for recesses that provide different alignment possibilities between building elements are described below in greater detail.

Coupling elements, for example, a male stud of a standard building element of the toy construction system, can be arranged in a uniform two-dimensional array structure, grid, or pattern (that is an x-z plane where x and z are perpendicular axes of a Cartesian coordinate system defining the plane, and x and z are the dimensions of the plane) on the surface of a building element which allow for easy coupling (and decoupling) with the similarly arranged female recesses of another building element. Typically, the building elements are referred to by the array formed on the surface of the building element. Thus, a 3×4 building element has 12 male coupling elements, for example, studs, arranged in four columns by three rows. When male coupling elements are arranged in a two dimensional plane in a regular pattern (for example, rows and columns), the minimum base distance between the centers (for example, the point at which the center axis in the y-dimension of the cylindrical stud male coupling element intersects the x-z plane) of any two adjacent studs in any one column or row of the plane (for example, where the columns and rows are parallel to the x dimension or the z dimension of the x-z plane respectively) is one building unit or 1BU. The distances between centers of the male coupling elements taken along a direction that is parallel with either the x or the z dimension in the x-z plane are a standard unit, which is an integer multiple of the base unit or BU. For example, a 1×3 standard building element (brick or plate) has three studs A, B, and C whose centers are arranged parallel to one dimension of the element (e.g., the z dimension) where the center of stud A is 1BU from the center of stud B and 2BUs from the center of stud C. In the implementations described, the building unit or BU of such a toy construction system is 8 mm.

Building elements can be combined using the coupling elements. Once combined the building elements can be held together with an interference fit. An interference fit is a friction fit in which the mechanical coupling or fastening between the coupling elements is achieved by friction after the coupling elements are pushed together, mated, seated, or otherwise mutually engaged. The interference fit also may involve a purposeful interference or deformation of one or more of the coupling elements when they are coupled, fastened, pushed together, or otherwise mutually engaged. Thus, the interference fit can be achieved by shaping the two coupling elements so that one or the other, or both, slightly deviate in size or form from their nominal dimension and one or more of the coupling elements slightly interferes with the space that the other is taking up.

In one example, the degree of an interference fit is sometimes referred to as "clutch." The amount of clutch provides an indication of the forces needed to combine and/or separate the coupling elements to or from each other. The degree or amount of contact between the coupling elements when coupled directly correlates to the amount of clutch provided. In addition, the number of points of contact between the coupling elements can determine the amount of clutch. For example, there may be three, four, five or more points of contact between a male stud and female recess, wherein more points of contact provide more clutch. With regard to female coupling elements, the point of contact is referred to herein as a "point of clutch." It is understood, that at "point of clutch" as used herein may refer to a point of contact, a line of contact, or an area of contact between two building elements.

A particular type of interference fit includes a snap-fit where the element-to-element attachment is accomplished with a locator component and a locking component that are homogenous with one or the other of the elements being joined. Joining requires the flexible locking component of one element to move or deform for complete engagement with a mating element, followed by return of the locking component toward its original position or form to accomplish the interference required to couple, lock, and join the components together. The locator component of the mating element typically is inflexible, minimally or non-deforming so to provide strength and stability to the attachment. In one example, two coupling elements are engaged in a snap fit to form a mechanical joint system wherein the build elements are able to be moved relative to each other or configured in different positions while the pieces remain mechanically joined or locked together.

A toy construction kit also can include other building elements that include one or more accessory coupling elements that have a second coupling size that is distinct from (for example, smaller than) the first coupling size so that the accessory coupling elements are not able to frictionally engage with the coupling elements of the standard building elements of the first size. For example, the second coupling size of standard accessories, such as rods, handles, and guns that are held by toy figures or placed within hollow cutout portions of standard sized studs are defined by an outside diameter of 3.18 mm.

The parts and pieces that form the toy construction kits, building elements, and any other accessories can be formed from plastic, such as, for example, acrylonitrile butadiene styrene (ABS) or any other suitable material. While not shown, the pieces that form the toy construction kits, building elements, and any other accessories may be an assortment of different colors and may be decorated in various ways, for example, with paint, decals, stickers, etchings, imprints, to represent a character or build associated with a particular theme, real or imaginary, for example, according to a particular product line.

The following description makes reference to special relations in addition to directional orientations, such as views with regard to the drawings. However, any terms such as up, down, left, right, top, bottom, front, back, above, below, underneath, upper, lower, and the like are used primarily to differentiate between the views and orientations relative to other building elements or pieces within any particular configuration, or series of views or illustrations, and to help describe the relationship between pieces to the reader. These terms are not intended to describe necessary real world orientations, unless otherwise noted or specified herein.

Figure 1B:
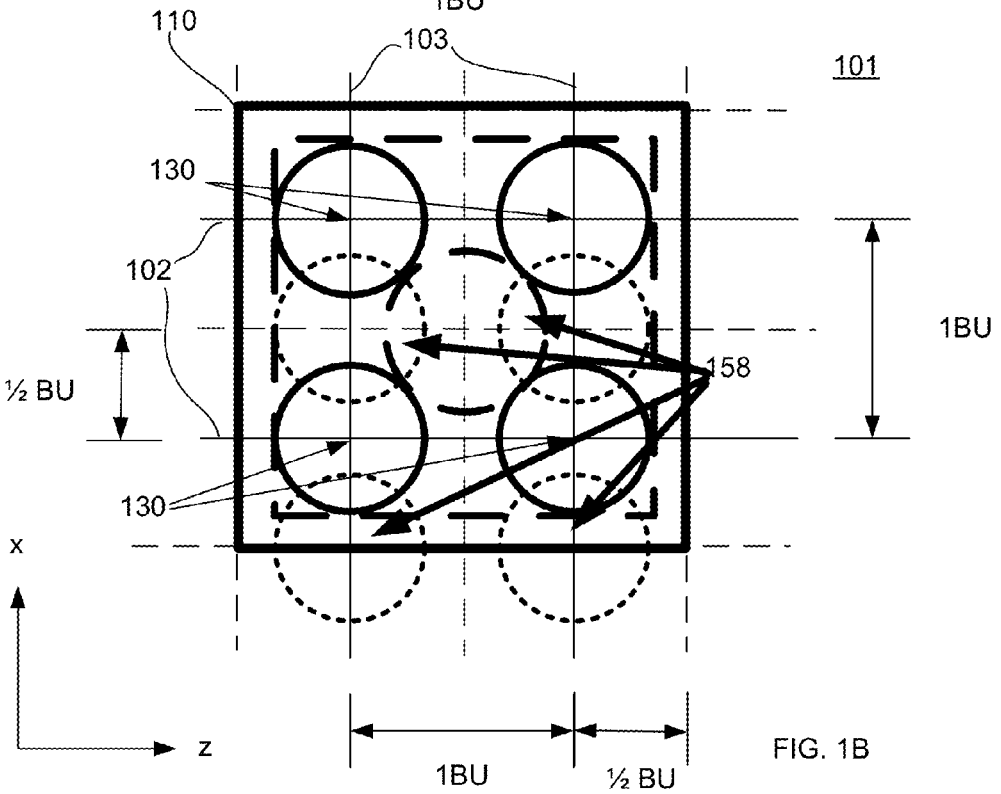
FIG. 1B illustrates another example of a spatial relationship in building units of a toy building element.

FIGS. 1A and 1B illustrate examples 100, 101 of spatial relationships for a building unit (BU) of a toy building element. FIGS. 1A and 1B illustrate a two dimensional grid in the x-z plane. The grid of solid lines illustrates rows 102 (in the z dimension) and columns 103 (in the x dimension) in units of 1BU (i.e., each solid line in the same dimension is 1BU apart from any adjacent line). The grid is imposed on a top view of an example of a toy building element 110 (for example, either a brick or plate) having a 2×2 grid of male and female coupling elements. The outer side of the building element 110 includes a perimeter wall 112 and four male cylindrical studs 114, 116, 118, and 120. The building element 110 also includes a hollow cavity created by the interior side 124 (indicated by a dashed line) of the perimeter wall 112. Centered inside the cavity is an inner cylindrical wall 126 (indicated by a dashed line). Four female recesses (not shown) with three points of clutch are located between two points 128 of the inner wall 124 and one point 129 on the inner cylindrical wall 126. The female recesses are located directly below a corresponding male stud 114, 116, 118, and 120.

As shown in the FIGS. 1A and 1B, each male stud (for example, 114) is centered at the intersection 130 of a row (in the z dimension) and a column (in the x dimension) and is 1BU from any adjacent male stud (for example, 116 and 118) in the same dimension (z or x). In addition, the center point of each male stud (for example, the intersection 130) aligns with a corresponding center of a female recess. The standard grid sizing of 1BU (or an integer number of BU's) allows building elements to be coupled according to the grid and intersections 130 by aligning one or more male studs with any corresponding female recesses such that centers of the studs and the centers of the recesses align according to the intersections 130 of the standard grid. In addition, according to this configuration of a standard 1BU grid, when two or more building elements are coupled, the centers of the male studs of one building element also align with the male studs of the corresponding building element to which it is coupled.

As shown in FIGS. 1A and 1B, the standard grid sizing of the building element 110 does not allow coupling in other non-standard grid alignments. For example, the standard 1BU grid configuration of coupling elements does not allow multiple male studs from another building element to couple with the building element 110 when not aligned in the with the intersection 130 of the rows and columns of the standard 1BU grid. As such, builders are restricted in how they can combine building elements.

For example, as shown in FIG. 1A, a 2×1 building element or a 4×4 building element with male studs (depicted by dashed circles) cannot combine with the building element 110 when the males studs of the other building element are centered ½ BU (or a fractional number of BUs) off in the x dimension since portions 150 of the walls 112, 126 interfere with coupling of the studs. Similarly, as shown in FIG. 1B, a 1×2 building element or a 4×4 building element with male studs (depicted by dashed circles) cannot combine with building element 110 when the males studs of the other building element are centered ½ BU off in the z dimension since portions 158 of the walls 112, 126 interfere with coupling of the studs.

Figure 2B:
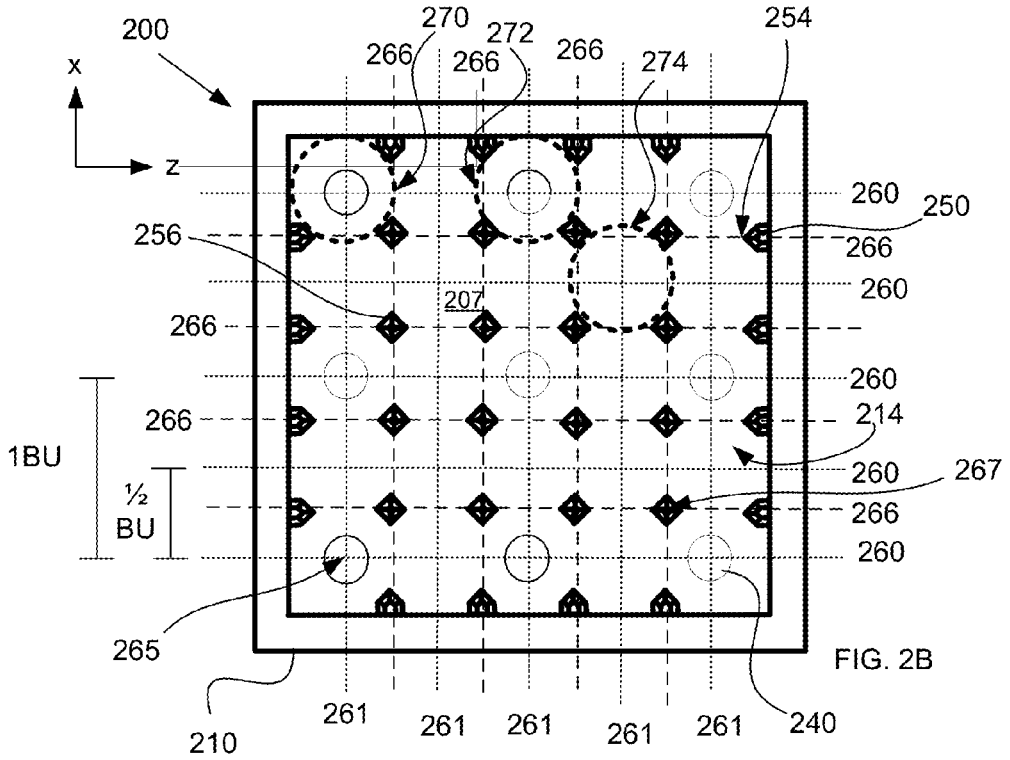
FIG. 2B is a bottom view of the example of the building element shown in FIG. 2A.
Figure 2A:
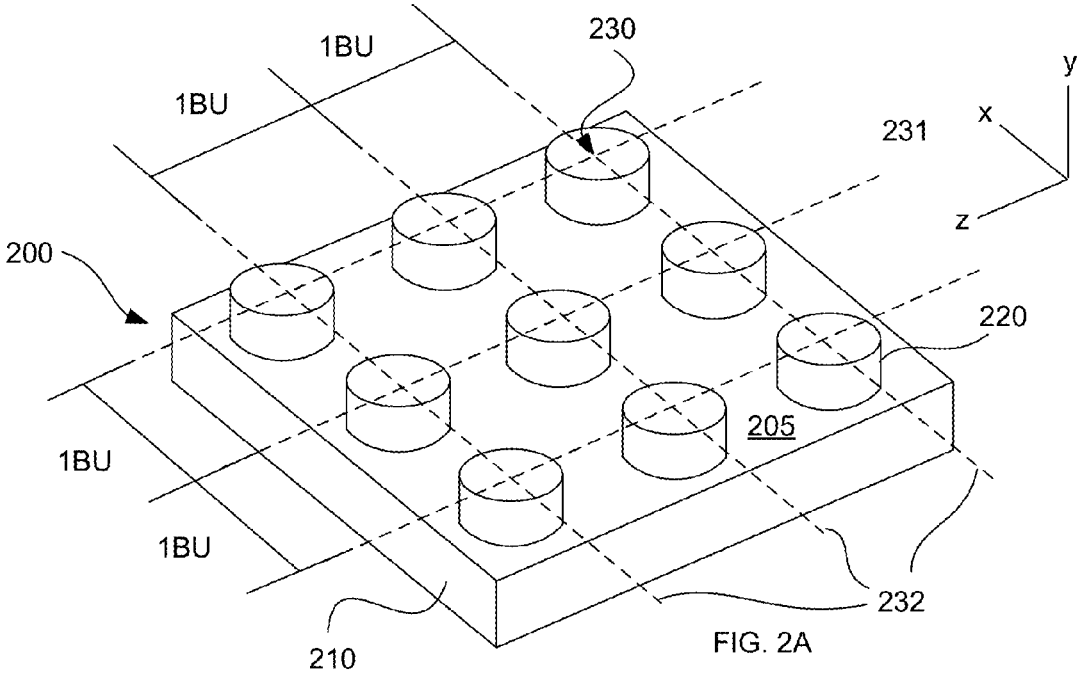
FIG. 2A is a top perspective view of an example of a building element that includes coupling recesses of the first coupling size configured to couple with male coupling elements of the first coupling size of another building element in both a standard coupling grid and a non-standard offset coupling grid.

FIGS. 2A and 2B show an example of a building element 200 that includes coupling recesses of the first coupling size configured to couple with male coupling elements of the first coupling size of another building element in both a standard coupling grid and a non-standard offset coupling grid. FIG. 2A is a top perspective view of the building element 200, and FIG. 2B is a bottom view of the building element 200.

As shown in FIGS. 2A and 2B, the building element 200 is a partially symmetrical, three dimensional building element that is constructed as unitary piece. In this example, the building element 200 is a 3×3 plate. The 3×3 plate measures 23.4 mm long×23.4 mm wide, by 3.2 mm high. The plate includes a top having an exterior surface 205 (shown in FIG. 2A) and interior surface 207 (shown in FIG. 2B) formed on a perimeter wall 210 that together bound a general cavity 214. The perimeter wall 210 has four equidistant exterior sides formed at right angles to each other to define a square.

Nine cylindrical, male studs, 220 of the first coupling size (for example, having an external diameter of 4.88 mm and height of 1.8 mm) extend orthogonally away from the exterior surface 205 of the top of the plate. As shown in FIG. 2A, the nine cylindrical, male studs 220 are arranged in a two dimensional configuration of three rows by three columns on the exterior surface 205. As FIG. 2A illustrates, the two dimensional configuration is standard 1BU coupling grid in the x-z plane. As shown in the FIG. 2A, each cylindrical, male stud 220 is centered at the intersection 230 of a row 231 in the z dimension and a column 232 in the x dimension where each row or column is separated by the distance 1BU (for example, 8 mm). As a result, the center axis of each cylindrical, male stud 220 is 1BU away from any adjacent cylindrical, male stud 220 in the same dimension (z or x).

FIG. 2B shows a bottom view of the general cavity 214 of the building element 200. As shown in FIG. 2B, the cavity 214 is bounded by the perimeter wall 210 and the bottom surface 207 of the top of the building element 200. While not required to manufacture the building element, and shown here to facilitate understanding of the concepts, nine indentations 240 in the bottom surface 207 are shown. Each indentation 240 corresponds to the inside of one of the cylindrical, male studs 220 arranged on the top surface 205 of the building element 200. As can be seen from FIG. 2B, the centers of the indentions 240 correspond to the centers of the cylindrical, male studs and are also 1BU from any adjacent indentation 240 in the x or z dimensions.

A number of female recess grid elements are arranged in the cavity 214 to form a non-standard ½ BU offset coupling grid. The grid elements can be configured to form female recesses of the first coupling size. The grid elements can include rib elements, posts, and/or walls.

In one example, a rib element is a protrusion or ridge formed along a wall that provides a point of clutch of a female coupling element. The rib element has a base that generally runs along the wall the rib element is formed on. For example, the rib element can run the height of the wall. However, the rib element should be positioned on a portion of the wall that allows contact with a male coupling element and long enough to provide enough friction to act as a point of clutch for the female coupling element or recesses accepting the male coupling element. The rib element protrudes away from the wall at a right angle and tapers to a point. In one example, the height of the rib element (i.e., the point of greatest distance from the wall) is slightly greater than the width of its base.

A post is an element that extends orthogonally from the interior surface of a building element into the cavity of the building element. The post extends to a height or distance from the interior surface of the building element into the cavity that allows contact with a male coupling element inserted into the cavity and has sufficient surface area to provide enough friction to act as a point of clutch for the female coupling element or recesses accepting the male coupling element. A cross section of the post can be a symmetrical geometrical shape, such as a circle or square that provides points of clutch for up to four different female coupling elements.

As shown in FIG. 2B, four rib elements 250 are formed at regular intervals along each interior side of the perimeter wall 210. In one example, the rib element 250 includes two parallel sides that extend from the wall at 90° angles for 0.50 mm before tapering to the point 254. The angle formed at the point 254 and distance of the point 254 from the perimeter wall 210 is dictated by the size of the male coupling element of the toy construction system in which the rib element 250 is used, since each rib element 250 provides a point of clutch in the female coupling element for the male coupling element of the same coupling size. For example, the angle formed at the point 254 of the rib element 250 can be 90°, and the distance from the point 254 from the inside of perimeter wall 210 the rib element 250 is formed on can be 1.0 mm (or 2.48 mm from the outside of the perimeter wall 210). In another example (not shown), the rib element can have a cross section shaped as a triangle in which two extend from the wall at an angle less 90° until they meet at a point 254. An end portion of the rib element 250 (for example, the portion closest to the opening of the cavity and the base of the perimeter wall) may be slightly rounded, tapered, or shaped to aid in alignment and insertion of a cylindrical, male stud into a corresponding female recess formed with the rib element 250.

In addition, a number of posts 256 extend orthogonally from the bottom surface 207 of the top. The center axis of each post 256 is parallel to the y axis. The width and length of the post 256 can be substantially equal forming a square cross section in the x-z plane having four corners (for example, each corner having a 90° angle). For example, the width and the length (being equal in a square cross section) of the post may be 0.82 mm. In another example, the post can have a circular cross section. The height of the post 256 corresponds to building type of building element (brick or plate) in which the post is formed. In this example, for a plate 200, the height of the post 256 is 1.8 mm. The end portion of the post (i.e., closest to opening of the cavity 214) may be slightly rounded or tapered to aid in alignment an insertion of a male stud into the corresponding female recess formed by the post.

One arrangement of grid elements according to a non-standard ½ BU offset coupling grid is shown in FIG. 2B. As shown in FIG. 2B, the ½ BU offset coupling grid is shown by dotted lines which form rows 260 in z dimension and columns 261 in the x dimension. The grid is formed as follows. A row is formed along each line that intersects the center points of indentations and is parallel to the z axis. A column is formed along each line that intersects the center points of indentations and is parallel to the x axis. These lines form a standard 1BU coupling grid. Additional rows and columns are formed by adding lines parallel to these rows and columns but located the midpoint between the lines in the same dimension to form a ½ BU offset coupling grid. According to the ½ BU offset coupling grid, a female recess of the first coupling size is centered at the intersection 265 of each row 260 and column 261. As shown in FIG. 2B, the cavity 214 includes 25 female recesses of the first coupling size arranged in the nonstandard ½ BU offset coupling grid.

The rib elements and/or posts are laid out according to the nonstandard ½ BU offset coupling grid with the rib elements 250 and posts 256 positioned between the rows and columns according to the grid. The grid elements can be positioned along grid element alignment lines 266 (shown with dashed lines) parallel with and located at the midpoint between adjacent rows 260 and adjacent columns 261. A rib element 250 is placed at each point where a grid element alignment line intersects the interior surface of the perimeter wall 210. Posts 256 can be placed at each point where the grid element lines intersect 267 (for example, the center point of the square formed between a pair of adjacent rows and columns of the ½ BU offset coupling grid). In one example, two opposite corners of the square cross section of the post 256 intersect one of the two grid alignment lines forming the intersection 267 where the post 256 is located.

The female recesses shown in FIG. 2B each have four or five points of clutch. The female recesses are formed by different combinations grid elements, for example, combinations of rib elements, posts, and/or perimeter walls. Three different types of grid element configurations forming female recesses are shown in FIG. 2B, highlighted by dotted circles 270, 272, and 274 illustrating interaction with a male coupling element.

A first type of female recess is provided at each corner of the building element 200 and includes two interior sides of the perimeter wall 210, two rib elements 250, and one post 256 providing five points of clutch. One example of the first type of female recess is shown engaging with a cylindrical, male stud represented in FIG. 2B by the dotted circle 270. A second type of female recess is provided along each side of the perimeter wall 210 between the corner female recesses and includes two rib elements 250, two posts 250 and the interior side of perimeter wall 210 providing five points of clutch. One example of the second type of female recess is shown engaging with a cylindrical, male stud represented in FIG. 2B by the dotted circle 272. A third type of female recess is provided by a grid in the interior of the cavity 214 surrounded by the other types of female recesses and includes four posts 250 providing four points of clutch. One example of the third type of female recess is shown engaging with a cylindrical, male stud represented in FIG. 2B by the dotted circle 274. As can be seen from FIG. 2B, each type of female recess is centered at an intersection 265.

Figure 2C:
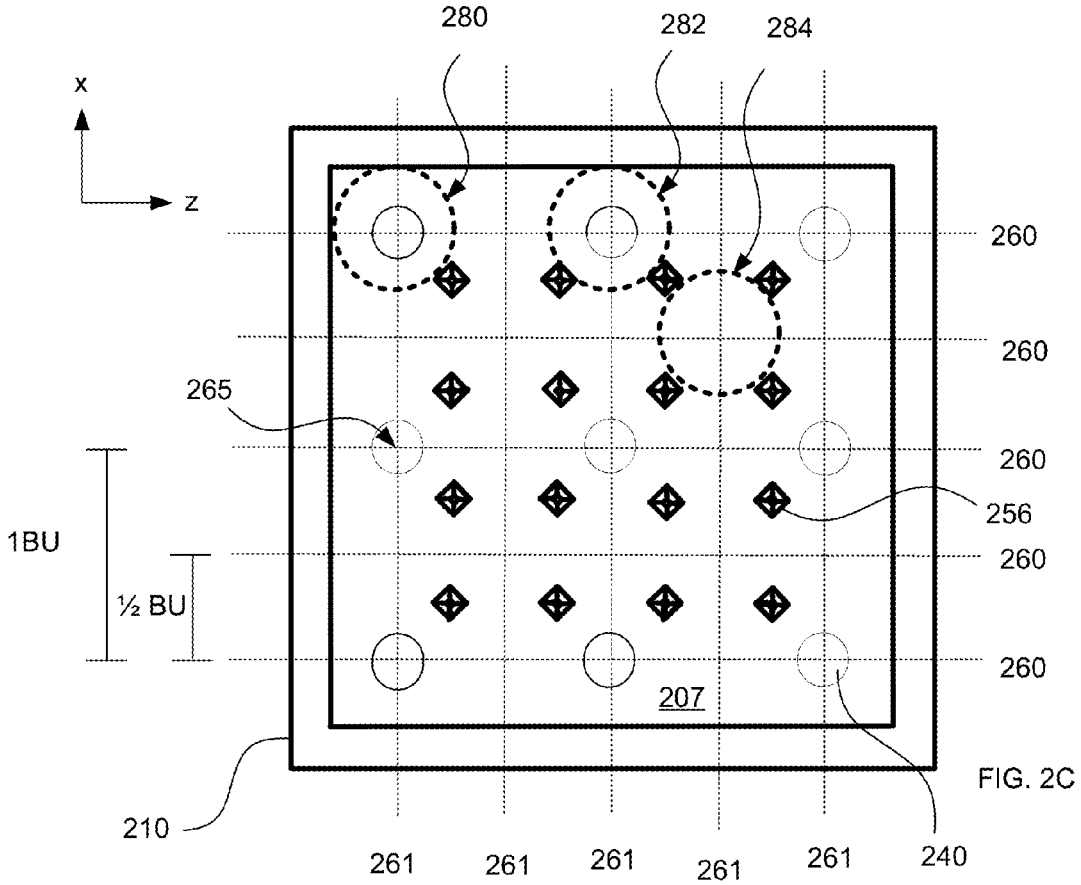
FIG. 2C is an alternative bottom view of the example of the exemplary building element shown in FIG. 2A.

Another arrangement of grid elements according to the non-standard ½ BU offset coupling grid is shown in FIG. 2C. The ½ BU offset coupling grid is formed as described above with regard to FIG. 2B. The position of the grid elements is the same as shown above for FIG. 2B, except the rib elements 250 are omitted.

In example shown in FIG. 2C, a fourth type of female recess is provided at each corner of the building element 200 and includes two interior sides of the perimeter wall 210 and one post 256 providing three points of clutch. One example of the fourth type of female recess is shown engaging with a cylindrical, male stud represented in FIG. 2C by the dotted circle 280. A fifth type of female recess is provided along each interior side of the perimeter wall 210 between the corner female recesses and includes two posts 250 and an interior side of the perimeter wall 210 providing three points of clutch. One example of the fifth type of female recess is shown engaging with a cylindrical, male stud represented in FIG. 2C by the dotted circle 282. The remaining female recesses are of the third type as described above shown engaging with a cylindrical, male stud represented in FIG. 2C by the dotted line circle 284.

Using female recess grid elements arranged according to a non-standard ½ BU offset coupling grid provides female recesses of the first coupling size that provide more coupling options when combining building elements allowing more flexibility of design choices to a builder. Using a non-standard ½ BU offset coupling grid allows male coupling elements of one building element to combine with the female recesses of: a standard 1BU coupling grid (where the male coupling elements of one building element align with the male building elements of a coupling building element in both the x and z dimensions); a z offset coupling grid (where the male coupling elements of one building element are offset with the male coupling elements of a coupling building element in the z dimension by ½ a BU); a x offset coupling grid (where the male coupling elements of one building element are offset with the male coupling elements of a coupling building element in the x dimension by ½ a BU); and a x-z offset coupling grid (where the male coupling elements of one building element are offset with the male coupling elements of a coupling building element in both the x and z dimensions by ½ a BU).

FIGS. 3A, 3B, 3C, and 3D show bottom views of examples illustrating the coupling alignments between two building elements using female recess grid elements arranged according to a non-standard ½ BU offset coupling grid. Two building elements are shown coupled in FIGS. 3A, 3B, 3C, and 3D. The first building element 200 is the 3×3 building element described above with reference to FIGS. 2A and 2B. The second building element 300 is a 2×2 building element having four cylindrical, male coupling elements of the first coupling size represented by dotted circles 310.

The 3×3 building element 200 shown in FIGS. 3A, 3B, 3C, and 3D has 25 female recesses of the first coupling size. Based on the orientation shown in the drawings, the female recesses can be identified by row, column with the point of origin (0,0) starting in the lower left hand corner of the building element 300 as follows: 1,1; 1,2; 1,3; 1,4; 1,5; 2,1; 2,2; 2,3; 2,4; 2,5; 3,1; 3,2; 3,3; 3,4; 3,5; 4,1; 4,2; 4,3; 4,4; 4,5; 5,1; 5,2; 5,3; 5,4; 5,5.

Figure 3B:
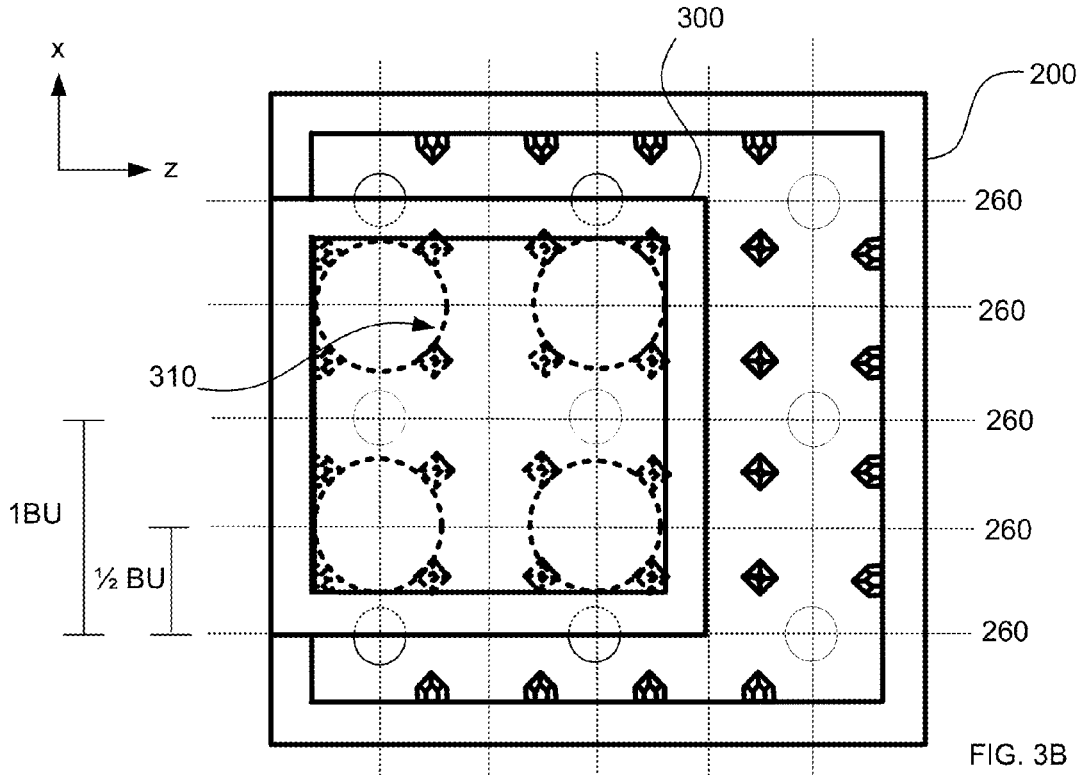
FIG. 3B shows a bottom view of an example of the coupling of two building elements an offset alignment in the x dimension.
Figure 3A:
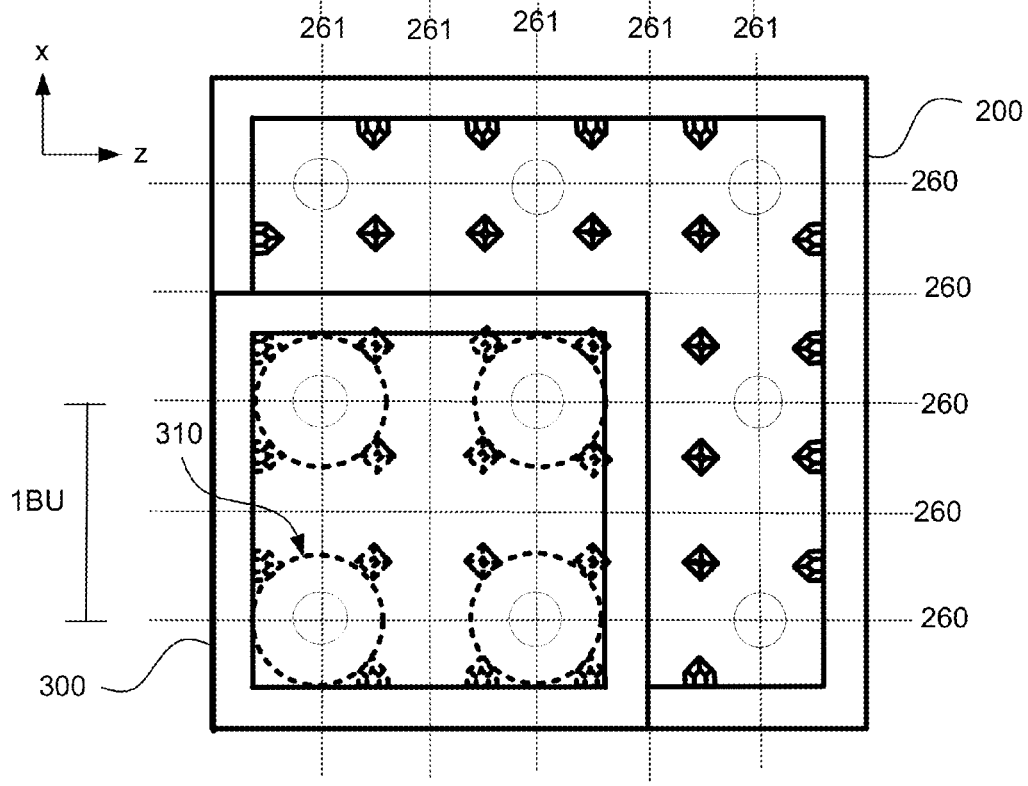
FIG. 3A shows a bottom view of an example of the coupling of two building elements in a standard alignment.

FIG. 3A shows one example of one configuration of the coupling of building element 200 and building element 300. As shown in FIG. 3A, the four cylindrical, male coupling elements 310 of the second building element 300 are inserted into the four female recesses 1,1, 1,3, 3,1, and 3,3 of the building element 200. In this configuration, the center axis of the four cylindrical, male coupling elements 310 of building element 300 align with the center axis of the nine cylindrical, male coupling elements 220 of building element 200 in both the x dimension and the z dimension according to a standard 1BU coupling grid. However, the female grid elements of the building element 200 provide additional non-standard alignments in which the cylindrical, male coupling elements of building element 300 are offset from the cylindrical, male coupling elements of building element 200 by ½ BU in the x dimension, the z dimension, or both the x and z dimensions.

FIG. 3B shows coupling of building element 200 and building element 300 with a ½ offset alignment in the x dimension. As shown in FIG. 3B, the four cylindrical, male coupling elements 310 of the second building element 300 are inserted into the four female recesses 2,1; 2,3; 4,1 and 4,3 of the building element 200. In this configuration, the center axis of the four cylindrical, male coupling elements 310 of building element 300 do not align with the center axis of the nine cylindrical, male coupling elements 220 of building element 200 in the z dimension. Instead, the cylindrical, male coupling elements 310 of building element 300 are offset by ½BU in the z dimension where the center axis of cylindrical, male coupling elements 310 of building element 300 align with the center axis of cylindrical, male coupling elements 220 of building element 200 along the columns 261 but are offset ½ BU along the rows 260.

Figure 3C:
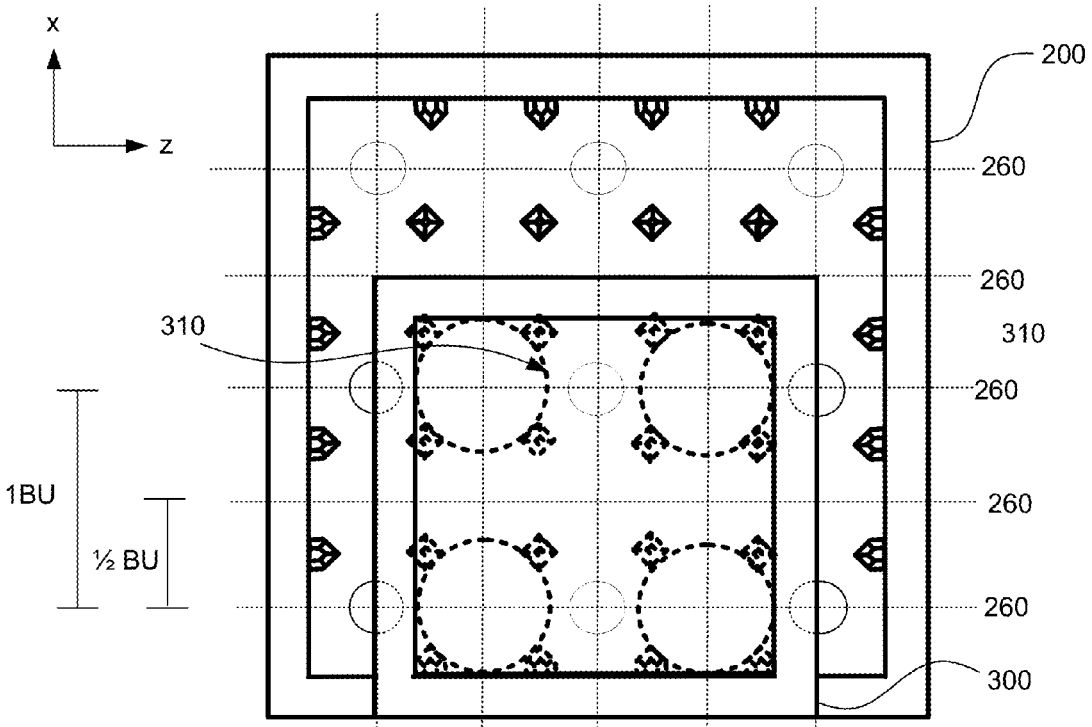
FIG. 3C shows a bottom view of an example of the coupling of two building elements an offset alignment in the x dimension.

FIG. 3C shows coupling of building element 200 and building element 300 with a ½ offset alignment in the x dimension. As shown in FIG. 3C, the four cylindrical, male coupling elements 310 of the second building element 300 are inserted into the four female recesses 1,2; 1,4; 3,2 and 3,4 of the building element 200. In this configuration, the center axis of the four cylindrical, male coupling elements 310 of building element 300 do not align with the center axis of the nine cylindrical, male coupling elements 220 of building element 200 in the x dimension. Instead, the cylindrical, male coupling elements 310 of building element 300 are offset by ½BU in the x dimension where the center axis of cylindrical, male coupling elements 310 of building element 300 align with the center axis of cylindrical, male coupling elements 220 of building element 200 along the rows 260 but are offset ½ BU along the columns 261.

Figure 3D:
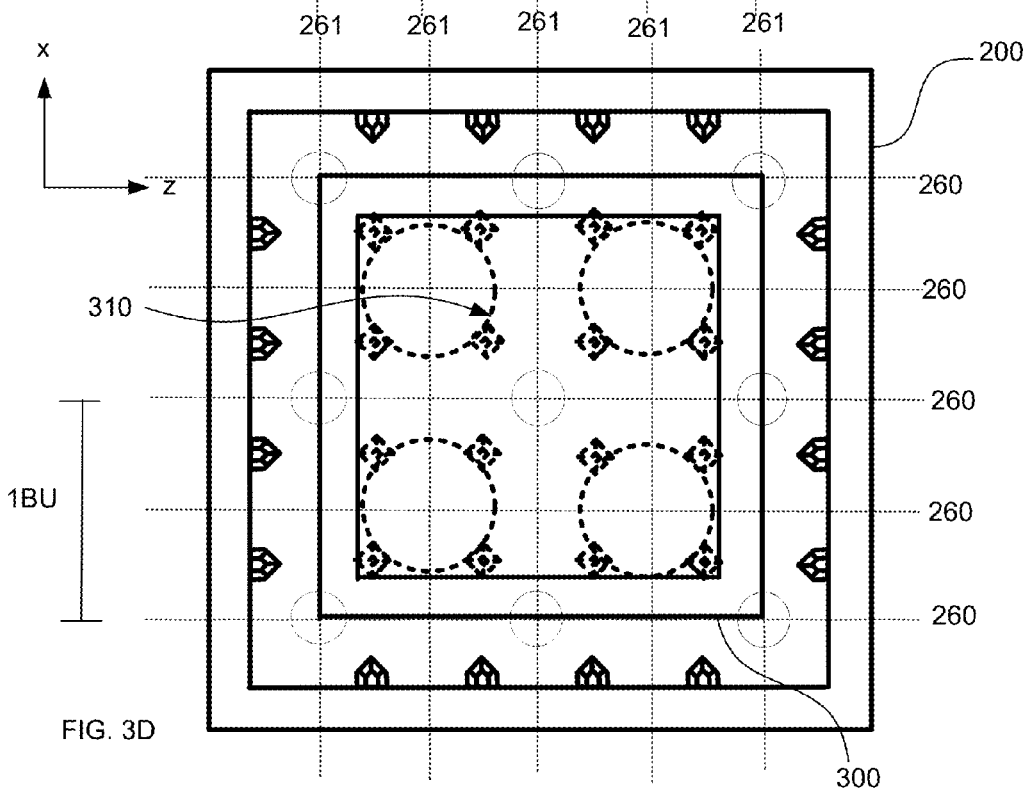
FIG. 3D shows a bottom view of an example of the coupling of two building elements an offset alignment in the x and z dimensions.

FIG. 3D shows coupling of building element 200 and building element 300 with a ½ offset alignment in the x and z dimensions. As shown in FIG. 3D, the four cylindrical, male coupling elements 310 of the second building element 300 are inserted into the four female recesses 2,2; 2,4; 4,2 and 4,4 of the building element 200. In this configuration, the center axis of the four cylindrical, male coupling elements 310 of building element 300 do not align with the center axis of the nine cylindrical, male coupling elements 220 of building element 200 in either the x or z dimensions. Instead, the cylindrical, male coupling elements 310 of building element 300 are offset by ½BU in both the x and z dimensions where the center axis of cylindrical, male coupling elements 310 of building element 300 do not align with the center axis of cylindrical, male coupling elements 220 of building element 200, but are offset ½ BU along the rows 260 and the columns 261.

As a result, using building elements with female recess grid elements arranged according to a non-standard ½ BU offset coupling grid gives a designer more flexibility when designing and creating constructions by allowing multiple male coupling elements to couple with a building element to offset the alignment of male coupling elements along one or dimensions in units less than 1BU.

In another example, a jumper plate is provided that is a specialty building element that allows various configurations, adaptations of, and alignments between standard building elements to allow additional flexibility and creativity in builder designs. In particular, various configurations of the jumper plate and other aspects of the elements described below, allow multiple male coupling elements of a building element to couple with a jumper plate in units less than 1BU of a standard coupling grid. Although the following description focuses on the jumper plate, certain design attributes and elements of the jumper plate are applicable to other toy construction building elements, as described in further detail below.

Figure 4A:
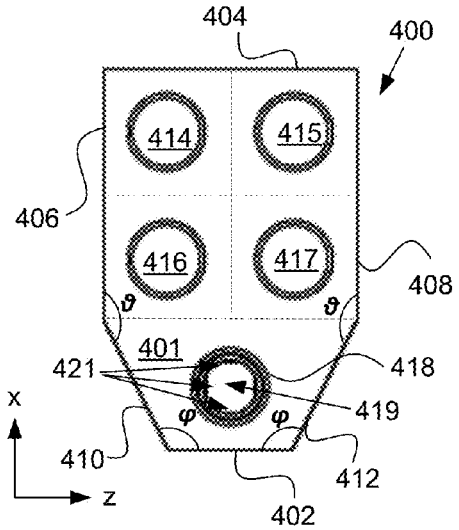
FIG. 4A is a top view of an example of building element in the form of a jumper plate.

FIGS. 4A-4E show an example of a jumper plate 400 that is a specialty building element for use with a toy construction system. The jumper plate 400 is a partially symmetrical, three dimensional build element that is constructed as unitary piece. As shown in FIGS. 4A-4E, one half the jumper plate 400 mirrors the other half of the jumper plate 400 through the x-y plane. FIG. 4A is a top view of an exemplary jumper plate 400. As shown in FIG. 4A, the jumper plate 400 includes a top wall 401. The top wall 401 is formed on and between a front wall 402 and a parallel back wall 404, on and between two parallel side walls 406, 408 arranged orthogonal to the back wall 404, and two non-parallel walls 410, 412 arranged at an obtuse angle θ from the parallel side walls 406, 408 (for example, greater than 90°) that taper the top wall 401 to the front wall 402 forming another obtuse angle ϕ with the front wall. In one example, θ is a 150° angle and ϕ is a 420° angle with the front wall 402. In addition, the side walls 404, 406, and 408 have lengths of 15.60 mm. The front side wall 402 has a length of 6.6 mm, and the side walls 410, 412 have a length of 9.01 mm. The walls 402, 404, 406, 408, 410, and 412 together form a perimeter wall of the jumper plate 400.

Five cylindrical, male studs, 414, 415, 416, 417, 418 of the first coupling size (for example, having a diameter of 4.88 mm and height of 1.80 mm) extend orthogonally from the exterior surface of the top wall 401. As shown in FIG. 4A, four of the studs 414, 415, 416, 417 are arranged in a 2×2 pattern (for example, two rows by two columns) on the exterior surface of the top wall 401. The studs are arranged such that if the exterior surface of the top wall is separated into a square (for example, 15.60 mm by 15.60 mm) formed by the back side wall 404 and parallel side walls 106, 108, for example, corresponding to the dimensions of a standard 2×2 building element, and a taper portion (for example, the remainder of the top surface) and the square is divided into four equal quadrants, the central axis of each stud is centered in each quadrant. In addition, the studs 414, 415, 416, 417 form a standard 1BU coupling grid.

The fifth stud 418 also extends from the exterior of the top surface and is centered in the tapered portion. In addition, the interior of the fifth stud 418 can be hollow creating a hole 419 that passes all the way through the jumper plate 400 that allows the stud 418 to receive a standard building element of the second coupling size (for example, a rod with diameter 3.18 mm). The interior side walls of the stud 418 forming the hole 419 may include a number of longitudinal flats 421 formed in the interior surfaces that define the hole 419 thereby offering at least four points of clutch for any building element of the second coupling size inserted therein. Moreover, the longitudinal flats 421 can be positioned and dimensioned based on the standard dimensions of structures to be received in the hole 419. For example, the distance between opposing flats may be 3.04 mm.

Figure 4E:
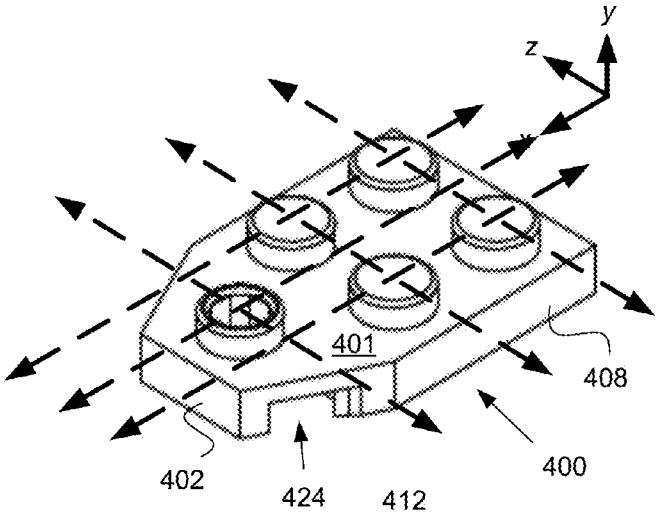
FIG. 4E shows an upper perspective view of the jumper plate of FIGS. 4A-D.
Figure 4B:
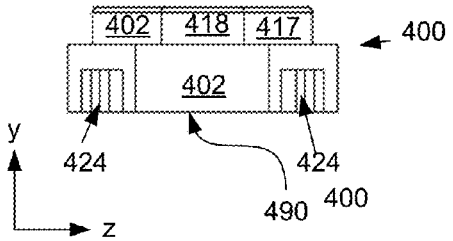
FIG. 4B is a front view of the jumper plate of FIG. 4A.

FIG. 4B is a front view of the jumper plate 400. As shown in FIG. 4B, the front of the jumper plate 400 includes the front wall 402 and the two non-parallel side walls 410, 412. The walls 402, 410, and 412 can have a height of 3.20 mm. Each of the non-parallel side walls 410 and 412 can have a cut out portion 424, described in further detail below. In addition, three of the five male studs 416, 417, 418 are shown extending orthogonally from the top surface 401 to a height of 1.80 mm.

Figure 4C:
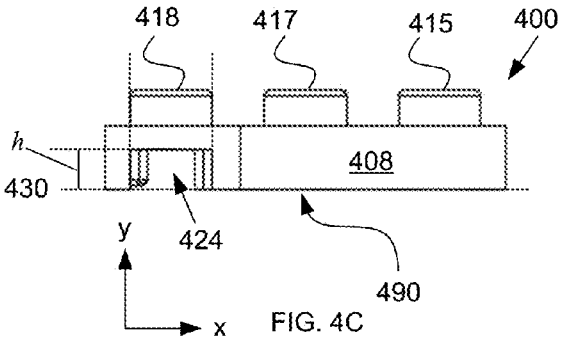
FIG. 4C is a side view of the jumper plate of FIGS. 4A and 4B.

FIG. 4C is a side view of the jumper plate 400. As shown in FIG. 4C, one of the sides of the jumper plate 400 includes side walls 408 and 412 (the other side that includes 406 and 410 is not shown but is symmetrical and therefore the description is omitted). The side wall 412 includes one of the two cutouts 224. A cutout 224 creates an opening in the wall 408 (and 406) that extends from the bottom or base of the wall (shown by the dashed line 230) to a height h that is slightly at least greater than 1.80 mm. In addition, the sides of the cutout 424 are aligned (for example, as shown with dotted lines) with the outer diameter of the stud 418 formed on the taper portion of the exterior surface of the top wall 401 of the plate 400 when viewed in the x-y plane. The cutout 424 prevents the walls 410, 412 from interfering with a male stud when the plate 400 is placed on another plate or brick as described, in further detail below. In addition, three of the five male studs 415, 417, and 418 are shown extending orthogonally from the top surface 401.

Figure 4D:
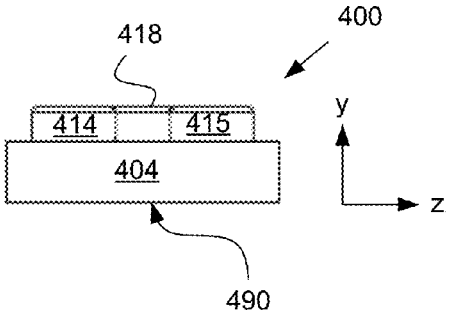
FIG. 4D is a back view of the jumper plate of FIGS. 4A-C.

FIG. 4D is a back view of the jumper plate 400. FIG. 4D shows the back wall 404 having a height of 3.20 mm. In addition, two and a portion of a third of the five male studs are shown extending orthogonally from the top surface 401.

FIG. 4E shows an top perspective view of the jumper plate 400. As can be seen from FIG. 4E, the four studs 414, 415, 416, 417 arranged in a 2×2 pattern form a uniform grid. The rows of the grid are separated by 1BU. The columns of the grid are also separated by 1BU. Together the rows and columns form a standard 1BU coupling grid. The fifth 418 stud is positioned in ½ BU offset with respect to the columns of the grid.

The underside 490 of the jumper plate 400 can have one of several different configurations. Different configurations of the underside 490 are shown in FIGS. 5A-9E and described in detail below.

Typically, standard building elements with multiple studs can only be coupled in a manner such that the studs of one building element directly align with the studs of another building element being coupled to it according to the standard 1BU coupling grid. This limits the way in which the building elements can be combined. However, the jumper plate provides the capability to allow building elements to be combined in a number of non-standard alignments allowing the jumper plate to jump from a standard alignment to an offset alignment. As a result, additional building elements may be coupled in the standard and offset alignments providing flexibility to designer when combining building elements to create a toy construct.

FIGS. 5A-5E, FIGS. 6A-6E, 7A-7E, 8A-8E, and 9A-9E show various examples of different configurations for the underside 490 of the jumper plate 400 that allow the jumper plate to couple with other building elements in standard and non-standard alignments.

Figure 5A:
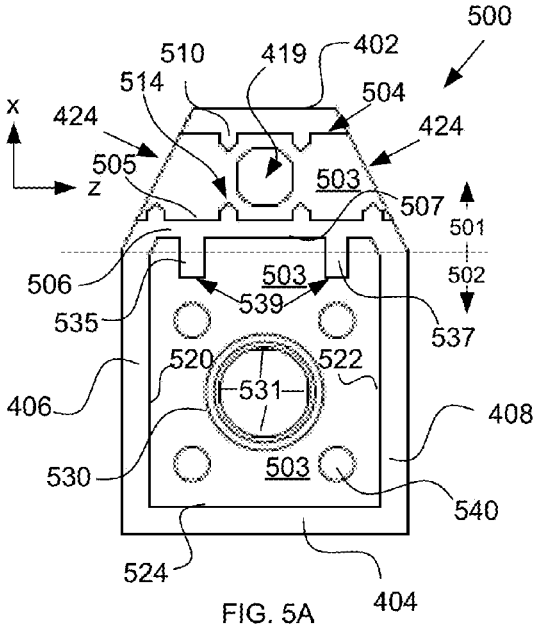
FIG. 5A is a bottom view of one underside configuration for the jumper plate of FIGS. 4A-E.
Figure 5B:
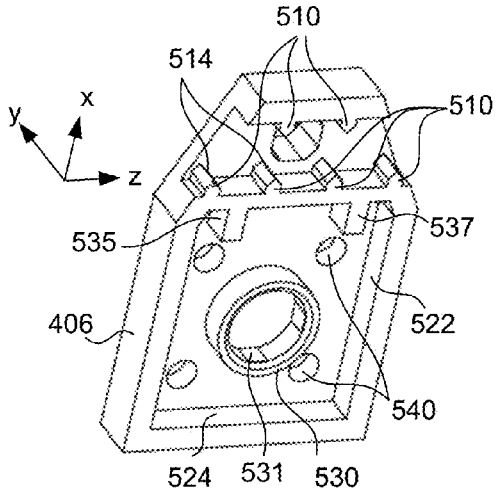
FIG. 5B is a lower perspective view of the bottom of the jumper plate shown in FIG. 5A.
Figure 5C:
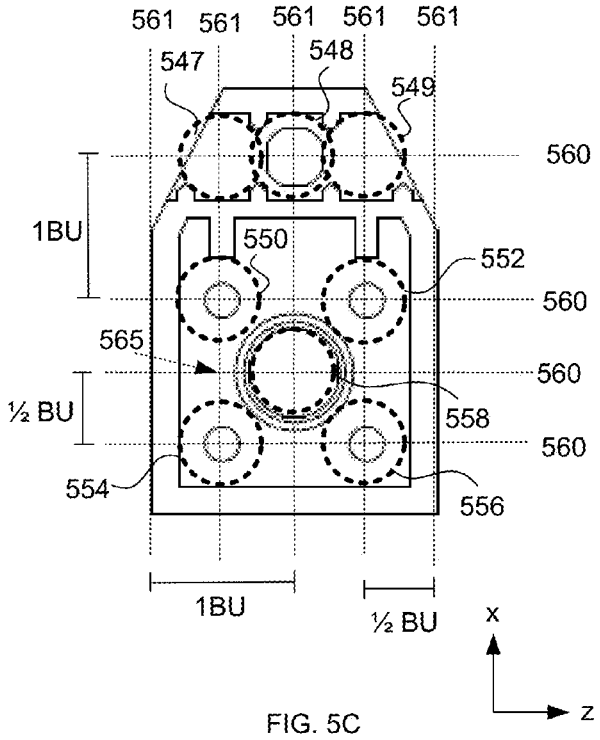
FIGS. 5C and 5D show a bottom view of an example of the jumper plate of FIGS. 4A-5B with a grid illustrating how male coupling elements combine with the jumper plate.
Figure 5D:
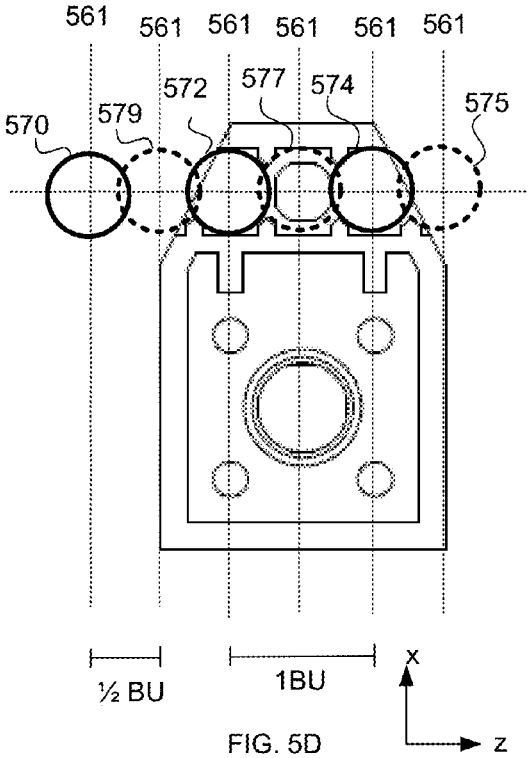

FIG. 5A is a bottom view of a particular configuration 500 of the underside 490 of jumper plate 400. FIG. 5B is a lower perspective view of the configuration 500 shown in FIG. 5A. FIG. 5C illustrates where male coupling elements of the first coupling size may be received by the jumper plate for the configuration 500. FIG. 5D illustrates alignments of male coupling elements of the first coupling size that may be received by the jumper plate in the tapered portion for the configuration 500. As shown in FIG. 5A the bottom of the jumper plate can be divided (along the dashed line) into a tapered portion 501 and a square portion 502 corresponding to the tapered and square portions described above with regard to FIG. 4A-4E.

The tapered portion 501 includes an open area formed between the cutouts 424 in the non parallel side walls 406, 408, bounded by the interior surface 503 of the top wall, the interior side 504 of the front wall 402, and a first side 505 of an inner wall 506. As shown, the hole 419 extends through the male stud 418 and the top wall 401 of the plate 500. The height of the interior side 504 of the front wall and the inner wall 506 is slightly greater than 1.80 mm.

Arranged along the interior side 504 of the front wall and the first side 505 of the inner wall 506, at regularly spaced intervals, are a number of protrusions, teeth, or rib elements 510. Each rib element 510 provides a point of clutch in the female coupling element for receiving and holding a male coupling element of the same coupling size as the female coupling element. The rib element 510 has a base that runs the entire height of the wall the rib element is formed on (for example, the inner side 504 of wall 402 and the first side 505 of the inner wall 506). A rib element protrudes or extends away from the wall at a right angle and tapers to a point. In one example, the height of the rib element (i.e., the point the rib element that is the greatest distance from the wall) is slightly greater than the width of its base of the rib element, for example 1.80 mm. As shown in FIG. 5A, the rib element 510 includes two parallel sides that extend from the wall at 90° angles for 0.50 mm before tapering to the point 514. The angle formed by the walls at the point 514 and distance of the point 514 from the wall is dictated by the size of the male coupling element of the toy construction system in which the rib element used, since each rib element 510 provides a point of clutch in the female coupling element for the male coupling element of the same coupling size. For example, the angle formed by the walls at the point 514 of the rib element 510 can be 90°, and the distance from the point 514 to the inside surface of the wall on which the rib element 510 is formed (for example, the inner side 504 of wall 402 and the first side 505 of the inner wall 506) can be 1.0 mm (or 2.48 mm from the outside of the perimeter wall 210).

The rib elements 510 are evenly spaced and positioned along a wall such that a grouping of three or more rib elements 510 provides a female coupling element of the first coupling size. As such, adjacent rib elements 510 formed on the same wall are evenly spaced, and a rib element 510 can be formed directly across from a rib element 510 on a wall opposite the rib element 510. The spacing or relative positioning of the rib elements 510 are described in further detail below with regard to FIGS. 5C and 5D. In the example shown in FIGS. 5A-5D, two rib elements 510 are formed on the interior side 504 of the front wall 502, and four rib elements 510 are formed on the first side 505 of the interior wall 506. In addition, the center lines each of the two rib elements on the interior side 504 of the front wall 402 are positioned directly across and opposite from the center lines of the two corresponding rib elements 510 on the first side 505 of the interior wall 506. In this example, three or four rib elements 510 can form a female coupling element of the first coupling size providing 5 or 6 points of clutch, respectively.

The square portion 502 of the bottom of the configuration 500 is a generally open area formed between the interior sides 520, 522 of the parallel side walls 406, 408 and the interior side 524 the back wall 404.

A circular wall 530 extends orthogonally from the bottom surface 503 of the top wall 402. The base of the circular wall 530 is centered around a center point of the square portion 502, for example, a point on the surface 503 that is 6.42 mm from the interior sides of the walls 406, 408, and back wall 404 (or 7.9 mm from the outside of the of the walls 406, 408, and back wall 404). The height of the circular wall 530 can be 1.80 mm. The inner diameter of the circle created by the wall 530 is of the first coupling size providing a female recess for a cylindrical male stud of the first coupling size. In addition, the interior walls of the circular wall 530 may include a number of longitudinal flats formed in the interior surfaces of the wall 530. Moreover, the longitudinal flats 531 can be positioned and dimensioned based on the standard dimensions of male studs of the first coupling size to be received in the recess formed by the circular wall. For example, the distance between opposing flats may be 4.84 mm. The outer diameter of the circular wall 530 is 6.50 mm.

Four indentations 540 into the bottom surface 503 of the top wall 401 are shown. Each indentation 540 corresponds to the inside of one of the cylindrical, male studs 414, 415, 416, and 417 arranged on the outer surface of the top wall 401 of the configuration 500. As can be seen from FIGS. 5A, 5C, and 5D, the center axis of the of the indentions 540 correspond to the center axis of the cylindrical, male studs and therefore are also 1BU from any adjacent indentation 540 in the x or z dimensions.

Two walls 535, 537 extend at right angles from the second side 507 of the inner wall 506 from the tapered portion into the square portion. The extension walls 535, 537 are the same height as the inner wall 506, and can have a thickness of 1.25 mm. The end portion 539 of the extension walls 535, 537 are parallel to the inner wall 506 and are positioned to form an area of clutch for a female coupling recess of the first coupling size formed by the interior side of a wall (406 or 408), and the outer side of the circular wall 530, and the end portion 539 of an extension wall 535 or 537. This female coupling recess has three points of clutch. Two additional female coupling recesses of the first coupling size are formed between the interior sides 520 or 522 of the side walls 406 or 408, the outer side of the circular wall 530, and the interior side 524 the back wall 404.

The configuration 500 provides eight female coupling elements of the first coupling size. These coupling elements are highlighted in FIG. 5C by circular dashed lines representing their interaction with cylindrical, male coupling elements that can be received by a corresponding recess. Three female coupling elements for stud positions 547, 548, 549 are provided in the tapered portion 501, and five coupling elements for stud positions 550, 552, 554, 556, 558 are provided in the square portion 502.

A female coupling element for stud position 550 is provided by the recess formed by the circular wall 530. Two female coupling elements for stud positions 552, 554, are formed between the interior sides 520, 522 of the side walls 406, 408, the circular wall 530, and the end portion 539 of the extension walls 535, 537; two additional female coupling elements for stud positions 556, 558 are formed between the interior sides 520, 522 of the side walls 406, 408, the circular wall 530, and the interior side 524 of the back wall 404.

In addition, three female coupling elements for stud positions 547, 548, and 549 located in the tapered portion 501 are formed by three or more ribbed elements 510. The female coupling elements for stud positions 547 and 549 are formed by three rib elements 510, one rib element positioned on the interior side 504 of front wall 402 and two on the first side 505 of inner wall 506. The female coupling element for stud position 548 is formed by four rib elements 510, two rib elements 510 positioned on the interior side 504 of front wall 402 and two rib elements 510 positioned on the first side 505 of inner wall 506. The female coupling elements for stud positions 547 and 549 have five points of clutch and the female coupling element for stud position 548 has six points of clutch.

The rib elements 510 can be positioned according to a non-standard ½ BU offset coupling grid as shown in FIGS. 5C and 5D. The ½ BU offset coupling grid is shown by dotted lines, which form rows 560 in the z dimension and columns 561 in the x dimension. The grid is formed as follows. A row is formed along each line that intersects the center points of indentations 540 and is parallel to the z axis. A column is formed along each line that intersects the center points of indentations 540 and is parallel to the x axis. These lines form a standard 1BU coupling grid. Additional rows and columns are formed by adding lines parallel to these rows and columns but located at the midpoint between the lines in the same dimension (x or z) to form a ½ BU offset coupling grid.

According to the ½ BU offset coupling grid, a female recess of the first coupling size is centered at the intersection 565 of the first row and each column 561. The rib elements 510 are laid out according to the nonstandard ½ BU offset coupling grid with the rib elements 510 positioned in the first row and each column according to the grid. The rib elements 510 can be positioned using grid element alignment lines that are parallel with and located at the midpoint between adjacent columns 261. A rib element 510 is placed at each point where an element alignment line intersects the interior side 504 of the front wall 402 and the first side 505 of the inner wall 506.

FIG. 5D shows an example illustrating the multiple positioning alignments of cylindrical, male coupling elements according to a nonstandard ½ BU offset coupling grid in the first portion 501. In this example, male coupling elements of a 1×3 building element are used to illustrate the positioning alignments. A first position of the male coupling elements (corresponding to a standard 1BU coupling grid alignment) for coupling of the 1×3 building element with the jumper plate 400 having the underside configuration 500 is shown by the solid line circles 570, 572, and 574. A second position of the male coupling elements of the 1×3 building element (corresponding to a non-standard ½ BU coupling grid) for coupling with the jumper plate 400 having the underside configuration 500 is shown by the dashed line circles 575, 577, and 579. According to the second position, the alignment of the male coupling elements of the 1×3 building element are shifted ½ BU in the z dimension.

Figure 6A:
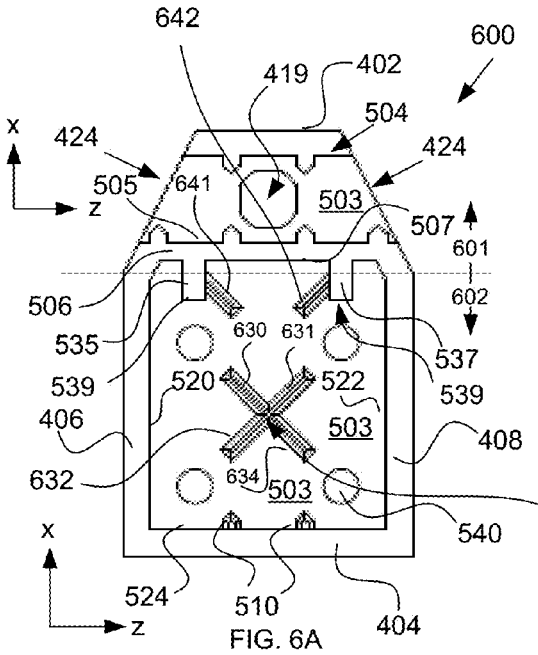
FIG. 6A is a bottom view of an alternative underside configuration for the jumper plate of FIGS. 4A-E.
Figure 6B:
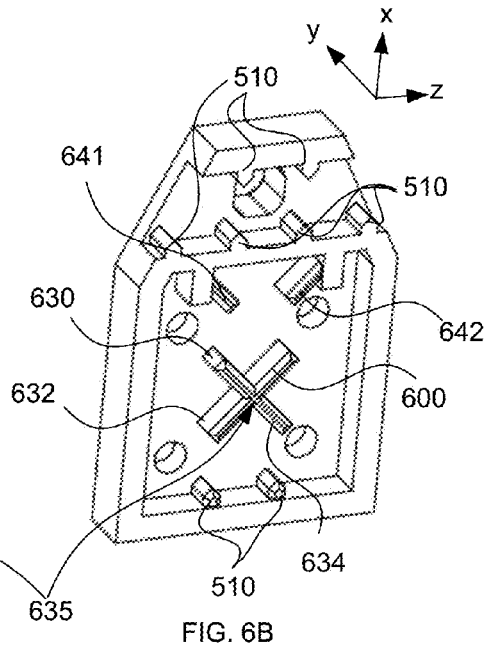
FIG. 6B is a lower perspective view of an example of the bottom of the jumper plate shown in FIG. 6A.
Figure 6C:
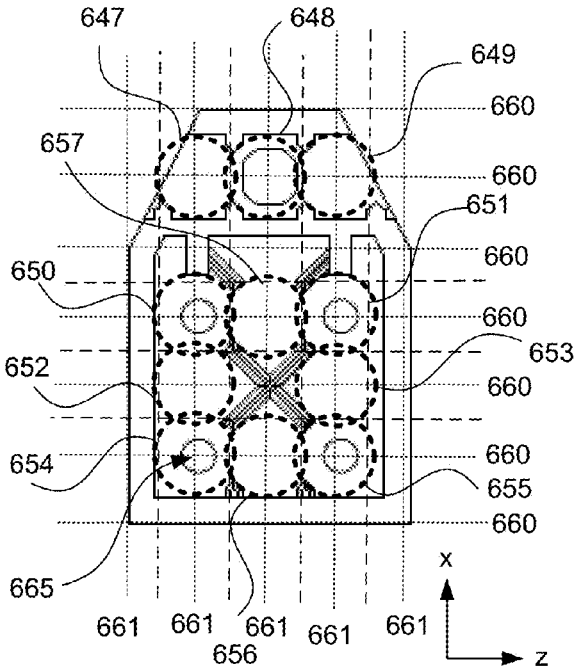
FIGS. 6C, 6D, and 6E show a bottom view of examples of a jumper plate of FIGS. 4A-4E, 6A, and 6B with a grid illustrating how male coupling elements combine with the jumper plate.
Figure 6D:
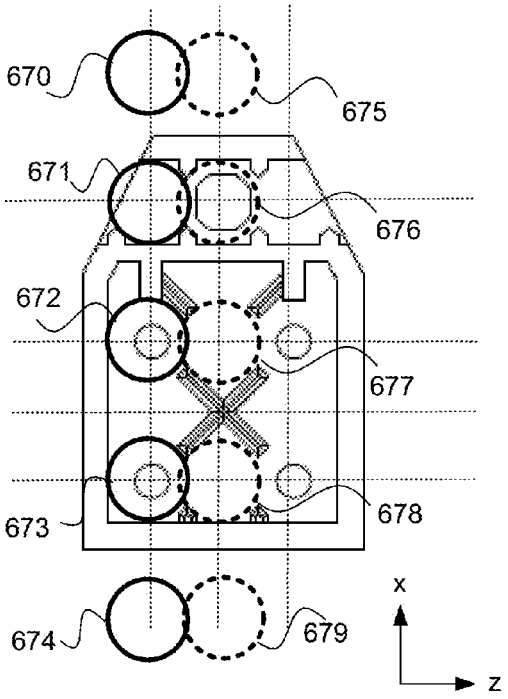
Figure 6E:
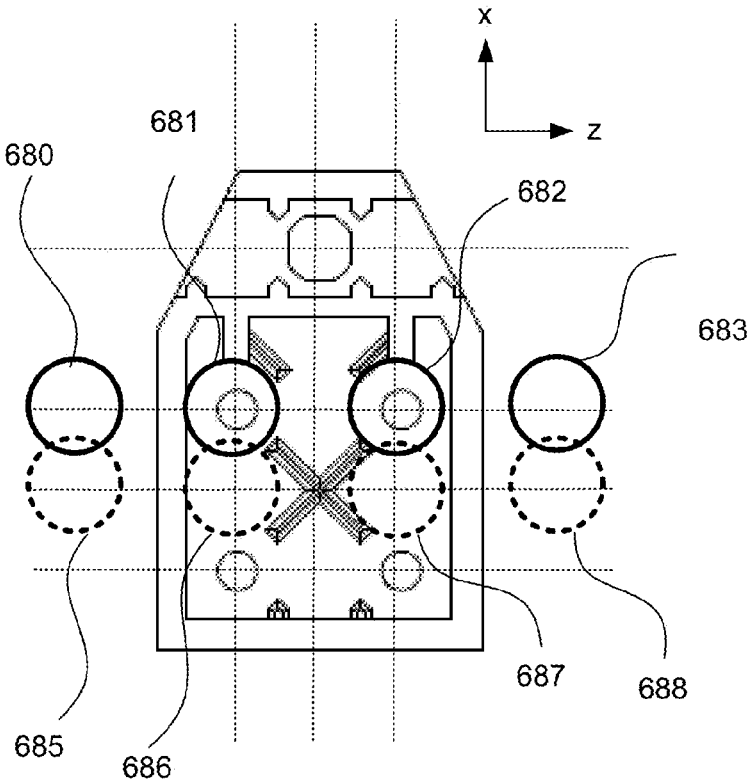

FIG. 6A is a bottom view of an alternative configuration 600 of the underside 490 of jumper plate 400. FIG. 6B is a lower perspective view of the configuration 600 of the underside 490 of the jumper plate 400. FIG. 6C illustrates where male coupling elements of the first dimension may be received by the jumper plate 400. FIGS. 6D and 6E illustrate multiple positioning alignments of cylindrical, male coupling elements according to a nonstandard ½ BU offset coupling grid.

As shown in FIGS. 6A, 6B, 6C, 6D, and 6E, the configuration 600 includes a tapered portion 601 and a square portion 602. The tapered portion 601 has the same configuration of elements as the tapered portion 501 of configuration 500 described above with regard to FIGS. 5A-5C; therefore, the description is not repeated here for brevity. The general configuration of the square portion 602 of the bottom of the configuration 600 is similar to the square portion 502 described above for configuration 500. As described above, a generally open area or cavity is formed between the interior sides 520, 522 of the parallel side walls 406, 408 and the interior side 524 the back wall 404. In addition, four indentations 540 in the bottom surface 503 of the top wall 401 are shown and positioned as described above. Similarly, two walls 535, 537 extend at right angles from the second side 507 of the inner wall 506 from the tapered portion 601 into the square portion 602.

However, instead of circular wall 530, four walls 630, 631, 632, and 634 forming a cross or x-shape extend orthogonally from the bottom surface 503 of the top wall 402. One end of each of the four walls 630, 631, 632, and 634 is connected at a common point 635 to form the cross, where each wall is formed at a 90° angle (in the x-z plane) to the two adjacent walls. The intersection of the walls or common point 635 is centered within the square portion 602, for example, at a position that is 6.42 mm from the interior sides of the walls 406, 408, and back wall 404 (or 7.9 from the outside of the of the walls 406, 408, and back wall 404). The height of the walls 630, 631, 632, and 634 is 1.80 mm. The cross section of each wall 630, 631, 632, and 634 in the x-z plane is generally rectangular. Each a wall is 0.82 mm wide and 2.83 mm long. The other ends of each of the four walls 630, 631, 632, and 634 opposite the intersection at the common point 635 are positioned to form an area of clutch for female coupling recesses of the first coupling size. The other ends 630, 631, 632, and 634 of each wall have a rectangular cross-section in the x-z plane with three sides of the rectangular cross section arranged at right angles to each other (thereby forming one end of the rectangular cross section).

In addition, two walls 641 and 642 extend orthogonally from the bottom surface 503 of the top wall 402. One end of wall 641 is connected to wall 535 forming 45° and 135° angles with the wall 535, and one end of wall 642 is connected to wall 537 forming 45° and 135° angles with the wall 537. The other ends opposite the connected ends of the walls 641 and 642 are generally oriented towards the center of the square portion 602 and each other. The cross section of each wall 641 and 642 in the x-z plane is generally rectangular, where the other ends of each wall 641 and 642 within the rectangular cross-section have three sides arranged at right angles to each other to form two adjacent corners of one end of the rectangular cross section and are positioned to form an area of clutch for female coupling recesses of the first coupling size.

Two rib elements 510 also are formed on the interior side of the back wall 404 in the same fashion as described above for the first portion 501 in FIGS. 5A-5C.

The configuration 600 includes eleven female coupling elements of the first coupling size. The female coupling elements can be formed using a number of grid elements including one or more of rib elements, walls, and end portions of walls to provide points of clutch for the female recess elements. The female coupling elements are highlighted in FIG. 6C by circular dashed lines representing their interaction with cylindrical, male coupling elements that can be received by the corresponding recesses. Three female coupling elements for stud positions 647, 648, 649 are provided in the tapered portion 601, and eight coupling elements for stud positions 650, 651, 652, 653, 654, 655, 656, 657 are provided in the square portion 602.

Two female coupling recesses for stud positions 650, 651 are formed between the interior sides 520, 522 of the side walls 406, 408, the end portions of walls 630, 631, the end portions of walls 641, 642, and the end portions 539 of the extension walls 535, 537. Two female coupling recesses for stud positions 652, 653 are formed between the interior sides 520, 522 of the side walls 406, 408, and the end portions of walls 630 and 632. Two female coupling recesses for stud positions 654, 654 are formed between the interior sides 520, 522 of the side walls 406, 408, and the end portions of walls 632 and 633, the interior side 524 of the back wall 404, and the rib elements 510. A female coupling recess for stud position 656 is formed between the end portions of walls 632 and 633, rib elements 510, and the interior side 524 of the back wall 404. A female coupling recess for stud position 657 is formed between the end portions of walls 630 and 631, rib elements 510, the end portions of walls 641, 642 and the end portion 539 of the extension walls 535, 537.

The arrangement of the grid elements (for example, end portions of walls 630, 631, 632, 633, 641, 642, and rib elements 510) can be positioned according to a non-standard ½ BU offset coupling grid as shown in FIG. 6C. The ½ BU offset coupling grid is shown by dotted lines which form rows 660 in z dimension and columns 661 in the x dimension. The grid is formed as described above with regard to FIG. 5C. According to the ½ BU offset coupling grid, a female recess of the first coupling size is centered at the intersections 665 of each row 660 and each column 661 within the tapered portion 601 and the square portion 602. Grid elements are laid out according to the nonstandard ½ BU offset coupling grid where the grid elements are positioned along grid element alignment lines (shown by dashed lines) that are parallel with and located at the midpoint between adjacent rows 660 and adjacent columns 661.

Figure 6F:
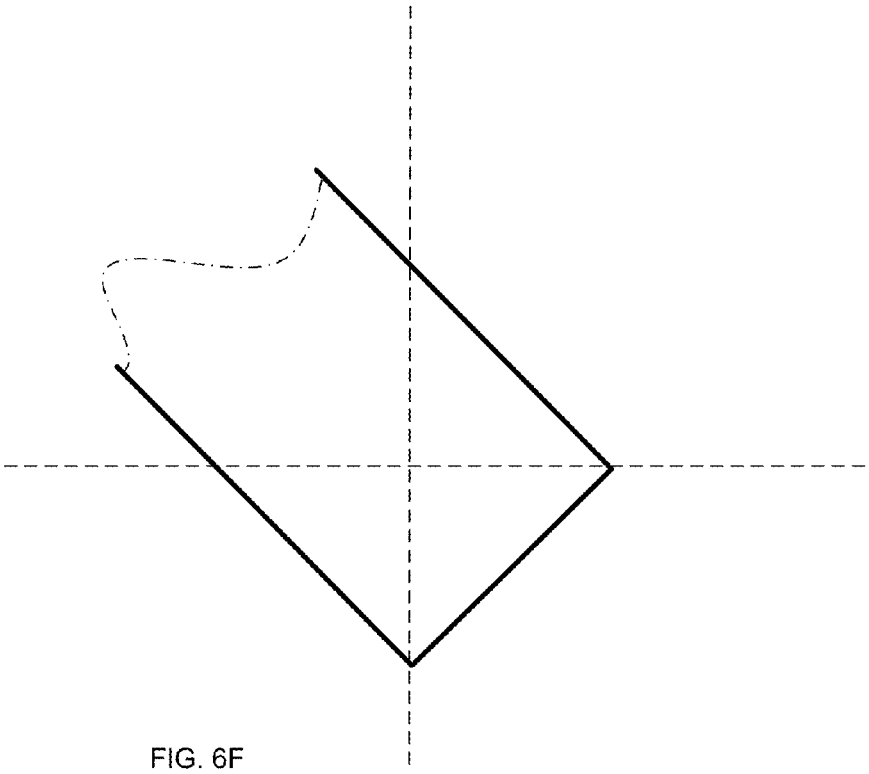
FIG. 6F shows a blow up of the grid element alignment lines and a cross section of an end portion.

A rib element 510 is formed at each point in the tapered portion 601 where an element alignment line intersects the interior side 504 of the front wall 402 and the first side 505 of the inner wall 506. In addition, a rib element 510 is formed in the square portion at each point where an element alignment line intersects the interior side 524 of the back wall 404 within the cavity. The end portions of walls 630, 631, 632, 633, 641, and 642 are positioned at the intersections of the grid element alignment lines within the square portion 602 where one of the two grid element alignment lines forming the intersection crosses through one of the two corners of the rectangular cross section and the other of the two grid element alignment lines forming the intersection crosses through the other corner of the rectangular cross section. A blow up view of an example illustrating the intersection of two gridlines and the orientation of an end portion of one of the walls 630, 631, 632, 633, 641, and 642 is shown in FIG. 6F.

FIG. 6D shows an example illustrating multiple positioning possibilities of cylindrical, male coupling elements of another building element according to a nonstandard ½ BU offset coupling grid for the configuration 600. The male coupling elements of a 1×5 building element in a first position (corresponding to a standard 1BU coupling grid alignment) for coupling with the jumper plate 400 is shown by the solid line circles 670, 671, 672, 673, and 674. A second position of the male coupling elements of the 1×5 building element (corresponding to a non-standard ½ BU coupling grid alignment) for coupling with the jumper plate 400 is shown by the dashed line circles 675, 676, 677, 678, and 679. According to the second position, the location and alignment of the male coupling elements has shifted ½ BU in the x dimension.

FIG. 6E shows another example illustrating multiple positioning possibilities of cylindrical, male coupling elements according to a nonstandard ½ BU offset coupling grid for the configuration 600. The male coupling elements of a 1×5 building element in a first position (corresponding to a standard 1BU coupling grid alignment) for coupling with the jumper plate 400 is shown by the solid line circles 680, 681, 682, and 683. A second position of the male coupling elements of the 1×5 building element (corresponding to a nonstandard ½ BU coupling grid alignment) for coupling with the jumper plate 400 is shown by the dashed line circles 685, 686, 687, and 688. According to the second position, the location and alignment of the male coupling elements has shifted ½ BU in the z dimension.

Figure 7F:
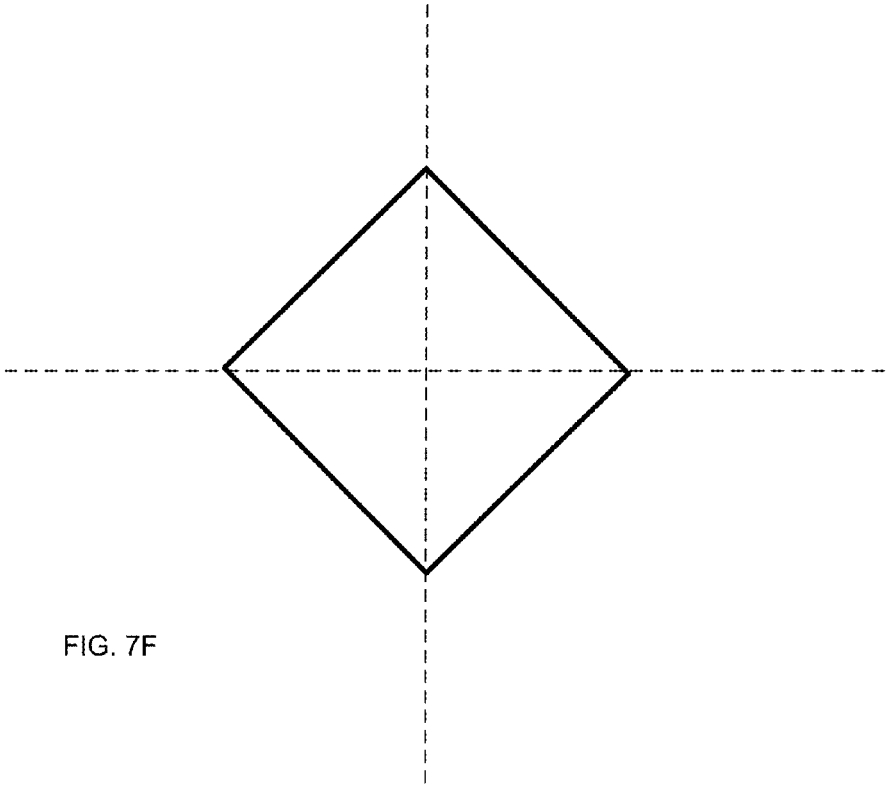
FIG. 7F shows a blow up of the grid element alignment lines and a cross section of a post.
Figure 7A:
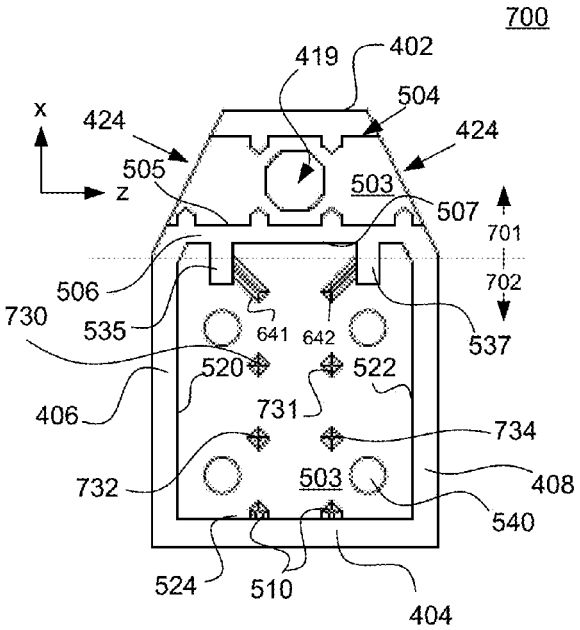
FIG. 7A is a bottom view of an alternative underside configuration for the jumper plate of FIGS. 4A-E.
Figure 7B:
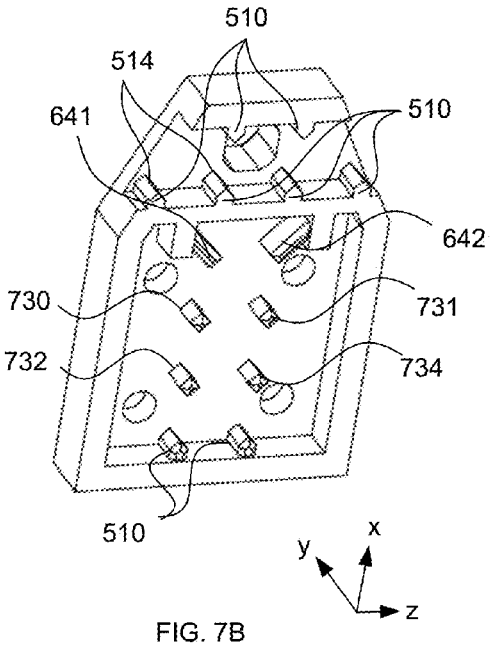
FIG. 7B is a lower perspective view of the bottom of the jumper plate shown in FIG. 7A.
Figure 7C:
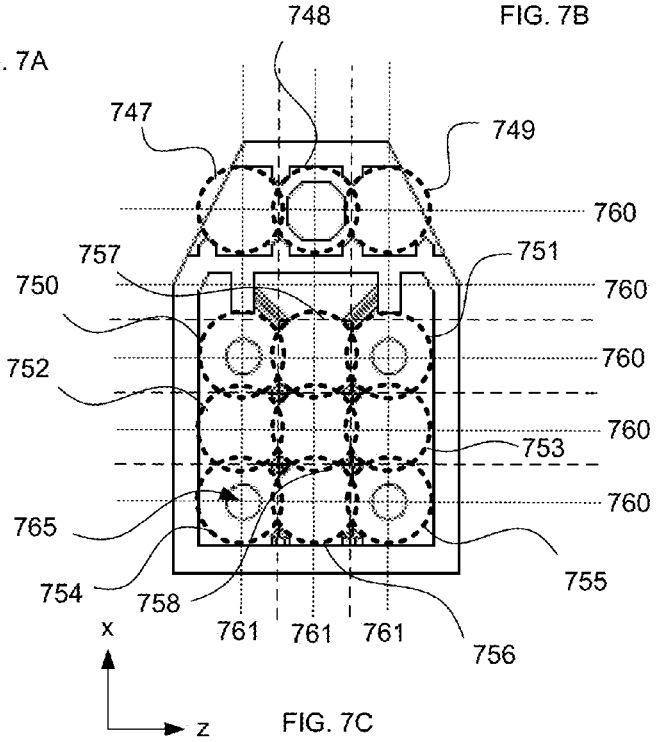
FIGS. 7C, 7D, and 7E show a bottom view of examples of a jumper plate of FIGS. 4A-4E, 7A, and 7B with a grid illustrating how male coupling elements combine with the jumper plate.
Figure 7D:
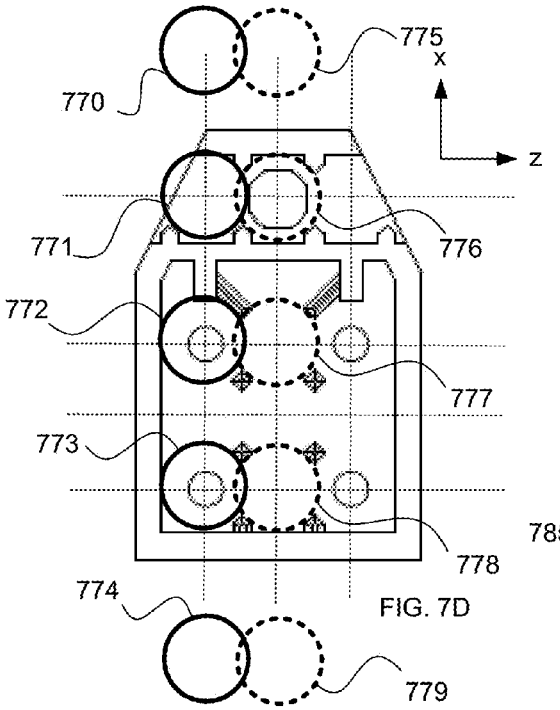
Figure 7E:
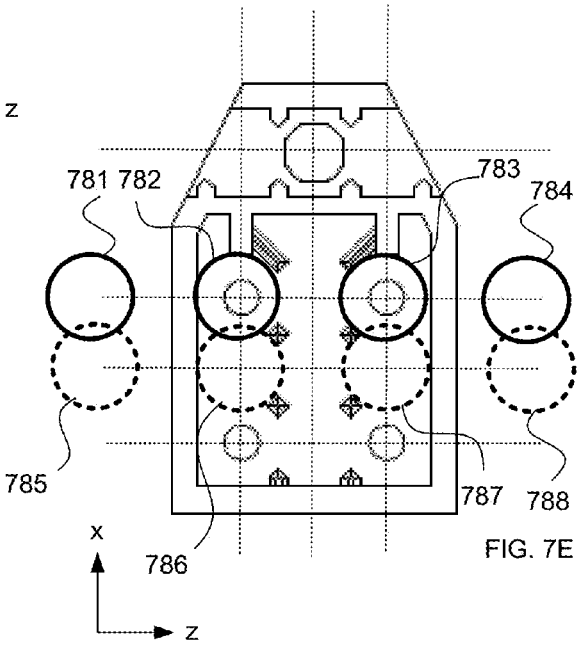

FIG. 7A is a bottom view of an alternative configuration 700 of the underside 490 of jumper plate 400. FIG. 7B is a lower perspective view of the configuration 700 of the underside 490 of the jumper plate 400. FIG. 7C illustrates where male coupling elements of the first dimension may be received by configuration 700 of the jumper plate 400. FIGS. 7D and 7E illustrate multiple positioning alignments of cylindrical, male coupling elements according to a nonstandard ½ BU offset coupling grid.

As shown in FIGS. 7A, 7B, 7C, 7D, and 7E, the configuration 700 includes a tapered portion 701 and a square portion 702. The tapered portion 701 has the same configuration of elements as the tapered portion 501 of the configuration 500 described above with regard to FIGS. 5A-5C; therefore, the description is not repeated here for brevity.

The general configuration of the square portion 702 of the bottom of the configuration 700 is similar to the square portion 602 described above for configuration 600. As described above, a generally open area or cavity is formed between the interior sides 520, 522 of the parallel side walls 406, 408 and the interior side 524 the back wall 404. In addition, four indentations 540 in the bottom surface 503 of the top wall 401 are shown and positioned as described above. Similarly, two walls 535, 537 extend 2.16 mm at right angles from the second side 507 of the inner wall 506 from the tapered portion 701 into the square portion 702.

However, instead of a cross or x-shape, in this example four posts 730, 731, 732, and 734 extend orthogonally from the bottom surface 503 of the top wall 402. The center axis corresponding to the height of the posts are the parallel to the y axis. The width and length of the post can be substantially equal forming a square cross section in the x-z plane. For example, the width and the length (being equal in a square cross section) of the posts may be 0.82 mm. The height of the posts can be 1.8 mm. The end portion of the post (i.e., closest to opening of the cavity) may be slightly rounded or tapered to aid in alignment an insertion of a male stud into the corresponding female recess formed by the post. The posts 730, 731, 732, and 734 are positioned to form points of clutch for female coupling recesses of the first coupling size.

In addition, two walls 641 and 642 extend orthogonally from the bottom surface 503 of the top wall 402 and two rib elements 510 on the interior side of the back wall 404 are formed as described above with regard to FIGS. 6A-6C.

The configuration 700 includes twelve female coupling elements of the first coupling size. The female coupling elements can be formed using a number of grid elements including one or more of rib elements, posts, and walls to provide points of clutch for the female recess elements. The female coupling elements are highlighted in FIG. 7C by circular dashed lines representing their interaction with cylindrical, male coupling elements that can be received by the corresponding recesses. Three female coupling elements for stud positions 747, 748, 749 are provided in the tapered portion 701, and nine coupling elements for stud positions 750, 751, 752, 753, 754, 755, 756, 757, and 758 are provided in the square portion 702.

Two female coupling recesses for stud positions 750, 751 are formed between the interior sides 520, 522 of the side walls 406, 408, the posts 730, 731, the end portions of walls 641, 642, and the end portions 539 of the extension walls 535, 537. Two female coupling recesses for stud positions 752, 753 are formed between the interior sides 520, 522 of the side walls 406, 408, and the posts 730 and 732. Two female coupling recesses for stud positions 754, 754 are formed between the interior sides 520, 522 of the side walls 406, 408, and the posts 732 and 733, the interior side 524 of the back wall 404, and the rib elements 510. A female coupling recess for stud position 756 is formed between the posts 732 and 733, rib elements 510, and the interior side 524 of the back wall 404. A female coupling recess for stud position 757 is formed between the posts 730 and 731, the end portions of walls 641, 642 and the end portion 539 of the extension walls 535, 537. A female coupling recess for stud position 758 is formed between the posts 730, 731, 732, and 734.

The arrangement of the grid elements (for example, posts 730, 731, 732, and 734, the end portions of walls 641, 642, and rib elements 510) can be positioned according to a nonstandard ½ BU offset coupling grid as shown in FIG. 7C. The ½ BU offset coupling grid is shown by dotted lines which form rows 760 in z dimension and columns 761 in the x dimension. The grid is formed as described above with regard to FIG. 5C. According to the ½ BU offset coupling grid, a female recess of the first coupling size is centered at the intersections 765 of each row 760 and each column 761 within the tapered portion 701 and the square portion 702. Grid elements are laid out according to the nonstandard ½ BU offset coupling grid where the grid elements are positioned along grid element alignment lines (shown by dashed lines) that are parallel with and located at the midpoint between adjacent rows 760 and adjacent columns 761.

A rib element 510 is formed at each point in the tapered portion 701 where an element alignment line intersects the interior side 504 of the front wall 402 and the first side 505 of the inner wall 506. In addition, a rib element 510 is formed in the square portion at each point where an element alignment line intersects the interior side 524 of the back wall 404 within the cavity. The posts 730, 731, 732, and 734 are positioned at the intersections of the grid element alignment lines within the square portion 702 where (for example, the center point of the square formed between a pair of adjacent rows and columns of the ½ BU offset coupling grid). In one example, two opposite corners of the square cross section of the posts 730, 731, 732, and 734 intersect one of the two grid alignment lines forming the intersection where the post is located. A blow up view of an example illustrating the intersection of two gridlines and the orientation of posts 731, 732, 733, 734 is shown in FIG. 7F. The end portions of walls 641, 642 are also positioned at two of the intersections of the grid element lines nearest the inner wall 506 where one of the two grid element alignment lines forming the intersection crosses through one of the two corners of the rectangular cross section and the other of the two grid element alignment lines forming the intersection crosses through the other of the two corners of the rectangular cross section.

FIG. 7D shows an example illustrating multiple positioning possibilities of cylindrical, male coupling elements of another building element according to a nonstandard ½ BU offset coupling grid for the configuration 700. The male coupling elements of a 1×5 building element in a first position (corresponding to a standard 1BU coupling grid alignment) for coupling with the jumper plate 400 is shown by the solid line circles 770, 771, 772, 773, and 774. A second position of the male coupling elements of the 1×5 building element (corresponding to a non-standard ½ BU coupling grid alignment) for coupling with the jumper plate 400 is shown by the dashed line circles 775, 776, 777, 778, and 779. According to the second position, the location and alignment of the male coupling elements has shifted ½ BU in the z dimension.

FIG. 7E shows another example illustrating multiple positioning possibilities of cylindrical, male coupling elements according to a nonstandard ½ BU offset coupling grid for the configuration 700. The male coupling elements of a 1×4 building element in a first position (corresponding to a standard 1BU coupling grid alignment) for coupling with the jumper plate 400 is shown by the solid line circles 780, 781, 782, and 783. A second position of the male coupling elements of the 1×4 building element (corresponding to a nonstandard ½ BU coupling grid alignment) for coupling with the jumper plate 400 is shown by the dashed line circles 785, 786, 787, and 788. According to the second position, the location and alignment of the male coupling elements has shifted ½ BU in the x dimension.

Figure 8E:
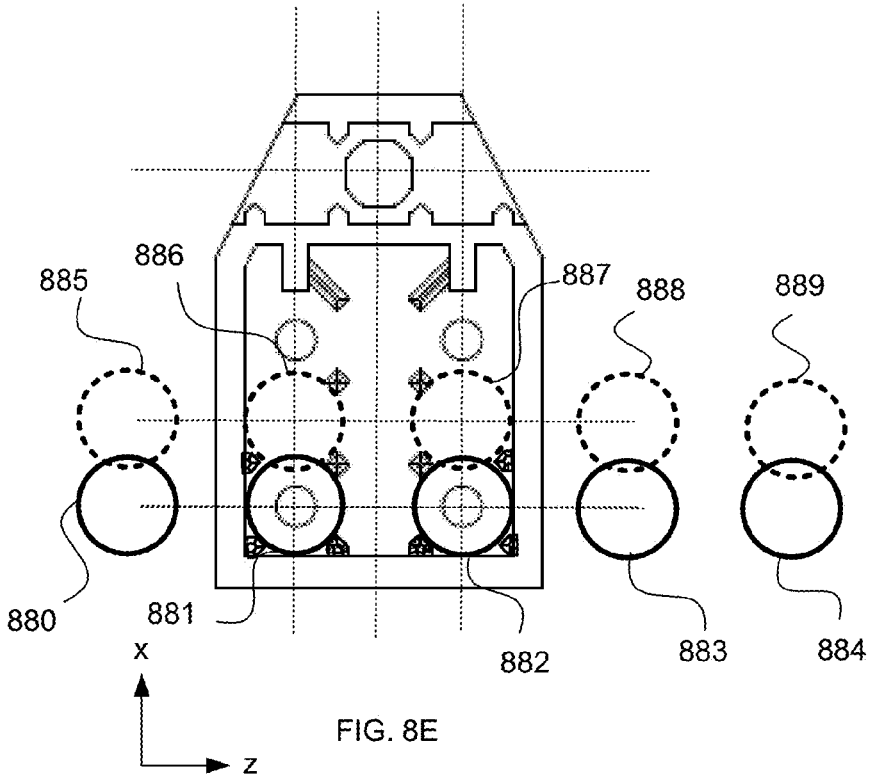
FIGS. 8C, 8D, and 8E show a bottom view of examples of a jumper plate of FIGS. 4A-4E, 8A, and 8B with a grid illustrating how male coupling elements combine with the jumper plate.
Figure 8D:
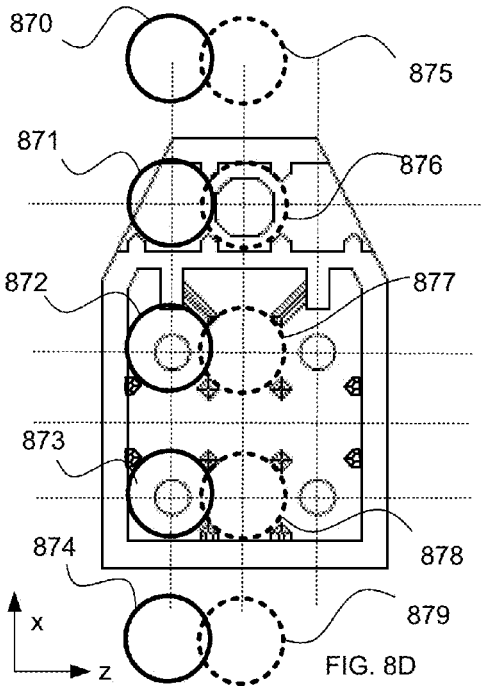
Figure 8A:
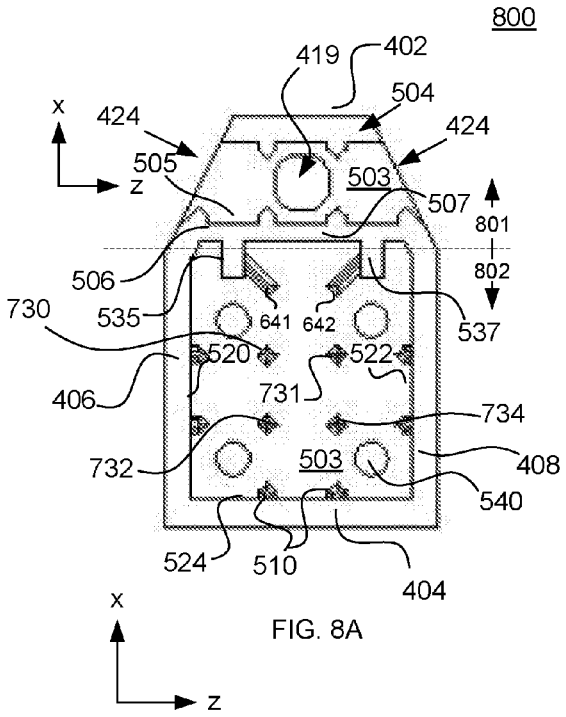
FIG. 8A is a bottom view of an alternative underside configuration for the jumper plate of FIGS. 4A-E.
Figure 8B:
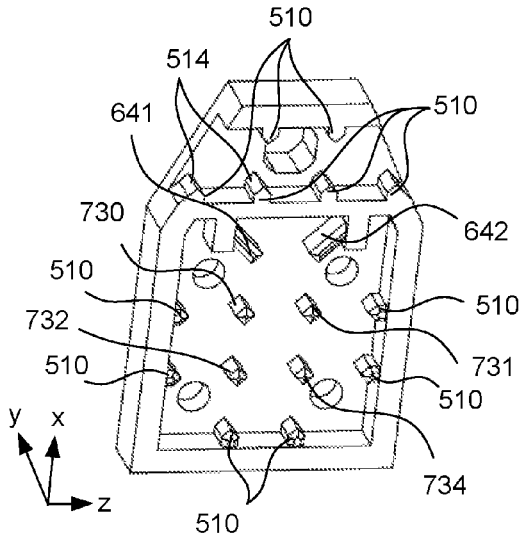
FIG. 8B is a lower perspective view of the bottom of the jumper plate shown in FIG. 8A.
Figure 8C:
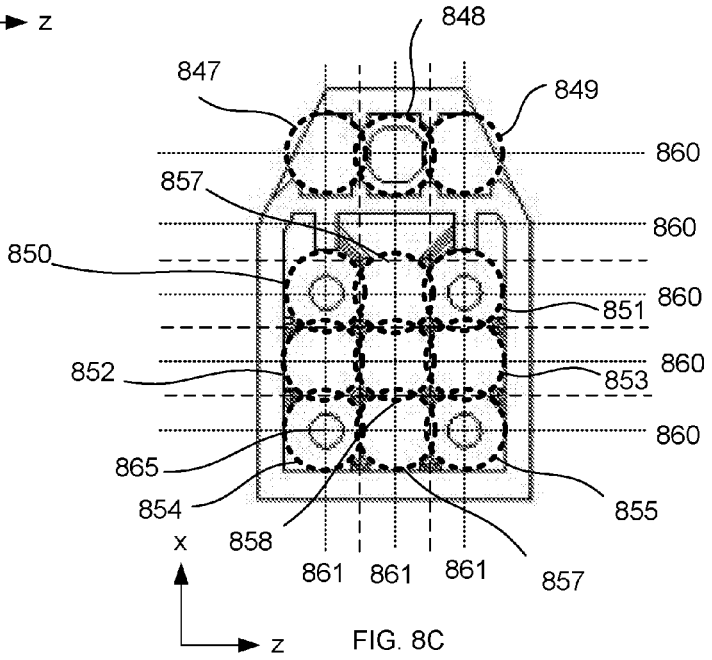

FIG. 8A is a bottom view of an alternative configuration 800 of the underside 490 of jumper plate 400. FIG. 8B is a lower perspective view of the configuration 800 of the underside 490 of the jumper plate 400. FIG. 8C illustrates where male coupling elements of the first dimension may be received by the jumper plate 400 with configuration 800. FIGS. 8D and 8E illustrate multiple positioning alignments of cylindrical, male coupling elements according to a nonstandard ½ BU offset coupling grid.

As shown in FIGS. 8A, 8B, 8C, 8D, and 8E, the configuration 800 includes a tapered portion 801 and a square portion 802. The tapered portion 801 has the same configuration of elements as the tapered portion 501 of the configuration 500 described above with regard to FIGS. 5A-5C; therefore, the description is not repeated here for brevity.

The general configuration of the square portion 802 of the underside 490 of the jumper plate 400 in the configuration 800 is similar to the square portion 702 described above for configuration 700. The configuration 800 provides all the grid elements in square portion 802 described above for the square portion 702 of configuration 700; therefore, their description is not repeated here for brevity. In addition, two additional rib elements 510 are formed on the interior sides 520, 522 of the parallel side walls 406, 408.

The configuration 800 includes twelve female coupling elements of the first coupling size. The female coupling elements can be formed using a number of grid elements including one or more of rib elements, posts, and walls to provide points of clutch for the female recess elements. The female coupling elements are highlighted in FIG. 8C by circular dashed lines representing their interaction with cylindrical, male coupling elements that can be received by the corresponding recesses. Three female coupling elements for stud positions 847, 848, 849 are provided in the tapered portion 701, and nine coupling elements for stud positions 850, 851, 852, 853, 854, 855, 856, 857, and 858 are provided in the square portion 802.

Two female coupling recesses for stud positions 850, 851 are formed between the interior sides 520, 522 of the side walls 406, 408, rib elements 510, the posts 730, 731, the end portions of walls 641, 642, and the end portions 539 of the extension walls 535, 537. Two female coupling recesses for stud positions 852, 853 are formed between the interior sides 520, 522 of respective side walls 406, 408, rib elements 510, and the posts 730 and 732. Two female coupling recesses for stud positions 854, 854 are formed between the interior sides 520, 522 of respective side walls 406, 408, and the posts 732 and 733, the interior side 524 of the back wall 404, and the rib elements 510. A female coupling recess for stud position 756 is formed between the posts 832 and 833, rib elements 510, and the interior side 524 of the back wall 404. A female coupling recess for stud position 857 is formed between the posts 730 and 731, rib elements 510, the end portions of walls 641, 642 and the end portion 539 of the extension walls 535, 537. A female coupling recess for stud position 858 is formed between the posts 730, 731, 732, and 734.

The arrangement of the grid elements (for example, posts 730, 731, 732, and 734, the end portions of walls 641, 642, and rib elements 510) can be positioned according to a non-standard ½ BU offset coupling grid as shown in FIG. 8C. The ½ BU offset coupling grid is shown by dotted lines and is the same as described above for FIG. 7C. In addition, all of the grid elements shown in FIG. 7C are positioned in 8B in the same manner using the grid element alignment lines as described above for FIG. 7C, and therefore the description is not repeated here for brevity.

In addition, four additional rib elements are provided by forming rib elements 510 at each point in the square portion 802 where an element alignment line intersects the interior sides of the walls in square portion (for example, 520, 522, 524 of the walls 404, 406, and 408). FIG. 8D shows an example illustrating multiple positioning possibilities of cylindrical, male coupling elements of another building element according to a nonstandard ½ BU offset coupling grid for the configuration 800. A first position of the male coupling elements of a 1×5 building element (corresponding to a standard 1BU coupling grid alignment) for coupling with the jumper plate 400 is shown by the solid line circles 870, 871, 872, 873, and 874. A second position of the male coupling elements of the 1×5 building element (corresponding to a non-standard ½ BU coupling grid alignment) for coupling with the jumper plate 400 is shown by the dashed line circles 875, 876, 877, 878, and 879. According to the second position, the location and alignment of the male coupling elements has shifted ½ BU in the z dimension.

FIG. 8E shows another example illustrating multiple positioning possibilities of cylindrical, male coupling elements according to a nonstandard ½ BU offset coupling grid for the configuration 800. The male coupling elements of a 1×4 building element in a first position (corresponding to a standard 1BU coupling grid alignment) for coupling with the jumper plate 400 is shown by the solid line circles 880, 881, 882, 883, and 884. A second position of the male coupling elements of the 1×4 building element (corresponding to a non-standard ½ BU coupling grid alignment) for coupling with the jumper plate 400 is shown by the dashed line circles 885, 886, 887, 888, and 889. According to the second position, the location and alignment of the male coupling elements has shifted ½ BU in the x dimension.

Figure 9A:
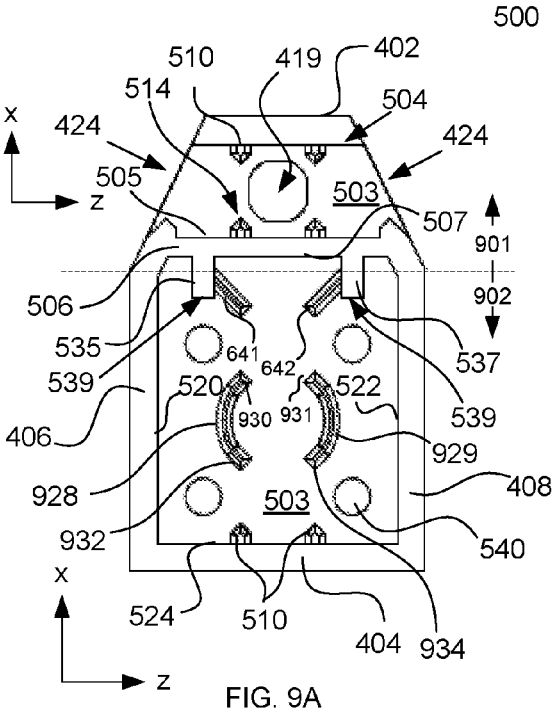
FIG. 9A is a bottom view of an alternative underside configuration for the jumper plate of FIGS. 4A-E.
Figure 9B:
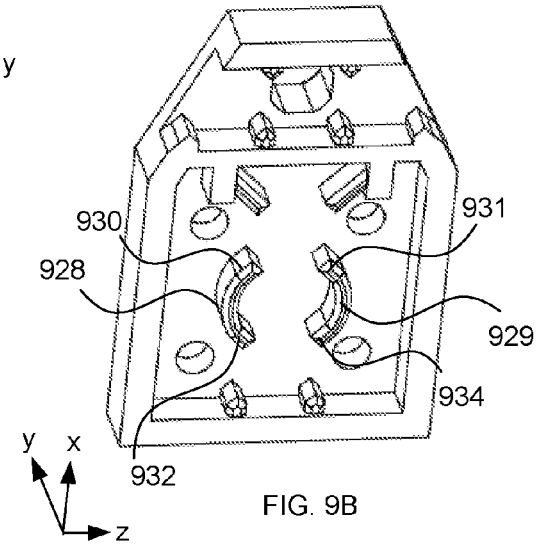
FIG. 9B is a lower perspective view of the bottom of the jumper plate shown in FIG. 9A.
Figure 9C:
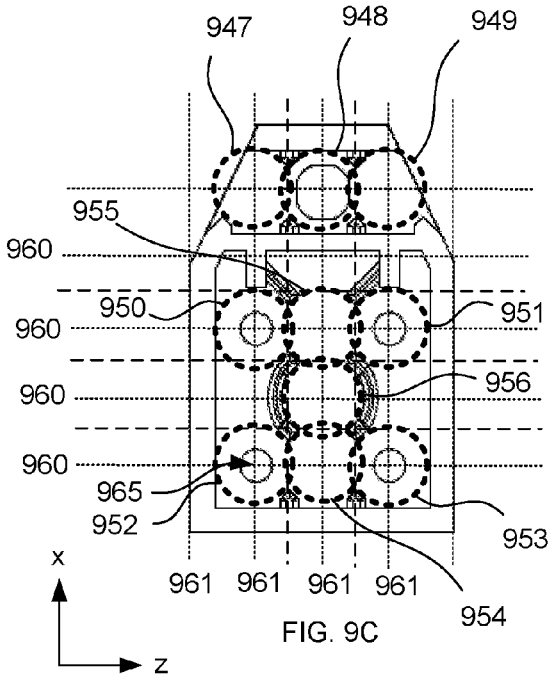
FIGS. 9C and 9D show a bottom view of examples of a jumper plate of FIGS. 4A-4E, 9A, and 9B with a grid illustrating how male coupling elements combine with the jumper plate.
Figure 9D:
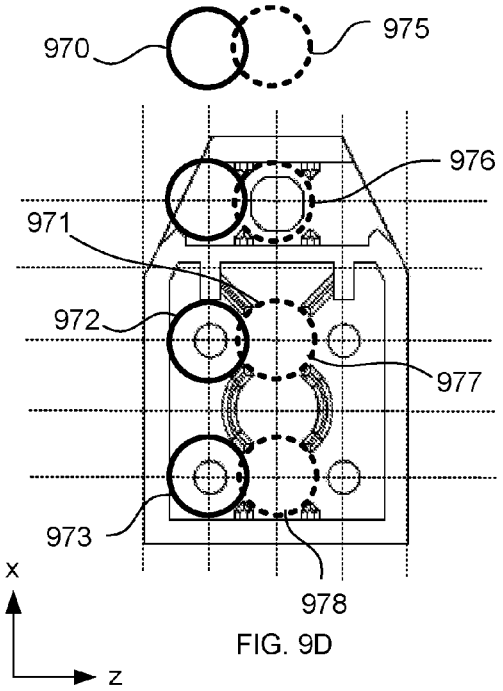

FIG. 9A is a bottom view of an alternative configuration 900 of the underside 490 of jumper plate 400. FIG. 9B is a lower perspective view of the configuration 900 of the underside 490 of the jumper plate 400. FIG. 9C illustrates where male coupling elements of the first dimension may be received by the jumper plate 400. FIG. 9D illustrates multiple positioning alignments of cylindrical, male coupling elements according to a nonstandard ½ BU offset coupling grid.

As shown in FIGS. 9A, 9B, 9C, and 9D, the configuration 900 includes a tapered portion 901 and a square portion 902. The tapered portion 901 has the same configuration of elements as the tapered portion 501 of configuration 500 described above with regard to FIGS. 5A-5C; therefore, the description is not repeated here for brevity.

The general configuration of the square portion 902 of the underside 490 of jumper plate 400 in the configuration 900 is similar to the square portion 602 described above for configuration 600. As described above, a generally open area or cavity is formed between the interior sides 520, 522 of the parallel side walls 406, 408 and the interior side 524 the back wall 404. In addition, four indentations 540 in the bottom surface 503 of the top wall 401 are shown and positioned as described above. Similarly, two walls 535, 537 extend at right angles from the second side 539 of the inner wall 506 from the tapered portion 901 into the square portion 902.

However, instead of a cross or x-shape, in this example two partial circular walls 928, 929 extend orthogonally from the bottom surface 503 of the top wall 402. The partial circular walls 928, 929 are positioned as the circular wall 530 where two opposite portions of the circular wall 530 are omitted or cut out to provide points of clutch for a female recess, with the remainder of the circular wall 530 forming partial circular walls 928, 929 having an outer diameter of 6.62 mm. The partial circular walls 928, 929 each have two end portions 930, 932 and 931, 934. The end portions have a rectangular cross-section in the x-z plane with three sides of the cross section arranged at right angles to each other forming an end of the rectangle.

In addition, two walls 641 and 642 extend orthogonally from the bottom surface 503 of the top wall 402 and are formed as described above with regard to FIGS. 6A-6C. In addition, two rib elements 510 also are formed on the interior side of the back wall 404 in the same fashion, as described above for the first portion 501 in FIGS. 5A-5C.

The configuration 900 includes ten female coupling elements of the first coupling size. The female coupling elements can be formed using a number of grid elements including one or more of rib elements, end portions, and walls to provide points of clutch for the female recess elements. The female coupling elements are highlighted in FIG. 9C by circular dashed lines representing their interaction with cylindrical, male coupling elements that can be received by the corresponding recesses. Three female coupling elements for stud positions 947, 948, 949 are provided in the tapered portion 901, and seven coupling elements for stud positions 950, 951, 952, 953, 954, 955, and 956 are provided in the square portion 902.

Two female coupling recesses for stud positions 950, 951 are formed between the interior sides 520, 522 of the side walls 406, 408, the end portions 930, 931, the end portions of walls 641, 642, and the end portions 539 of the extension walls 535, 537. Two female coupling recesses for stud positions 952, 953 are formed between the interior sides 520, 522 of respective side walls 406, 408, and the end portions 932 and 933, the interior side 524 of the back wall 404, and the rib elements 510. A female coupling recess for stud position 954 is formed between the end portions 932 and 933, rib elements 510, and the interior side 524 of the back wall 404. A female coupling recess for stud position 955 is formed between the end portions 930 and 931, the end portions of walls 641, 642 and the end portion 539 of the extension walls 535, 537. A female coupling recess for stud position 956 is formed between the two partial walls 928, 929.

The arrangement of the grid elements (for example, end portions 930, 931, 932, and 934, end portions of walls 641, 642, and rib elements 510) can be positioned according to a non-standard ½ BU offset coupling grid as shown in FIG. 9C. The ½ BU offset coupling grid is shown by dotted lines which form rows 960 in z dimension and columns 961 in the x dimension. The grid is formed as described above with regard to FIG. 5C. According to the ½ BU offset coupling grid, a female recess of the first coupling size is centered at the intersections 965 of each row 960 and each column 961 within the tapered portion 901 and the square portion 902. Grid elements are laid out according to the nonstandard ½ BU offset coupling grid where the grid elements are positioned along grid element alignment lines (shown by dashed lines) that are parallel with and located at the midpoint between adjacent rows 960 and adjacent columns 961.

The rib elements 510 in the tapered portion 901 and square portion 902 are formed as described above as are the end portions of walls 641, 642. The end portions of the circular walls 930, 931, 932, and 934 are positioned at the intersections of the grid element alignment lines within the square portion 902 where (for example, the center point of the square formed between a pair of adjacent rows and columns of the ½ BU offset coupling grid). In one example, the partial circular walls 928 and 929 are terminated at the end portions 930, 931, 932, and 934 as determined by the intersections of the grid element lines with circular walls 928 and 929 where one of the two grid element alignment lines forming the intersection crosses through one of the two corners of the rectangular cross section and the other of the two grid element alignment lines forming the intersection crosses through the other of the two corners of the rectangular cross section. As a result, the terminated end portions 930, 931, 932, and 934 form points of clutch for a female recess.

FIG. 9D shows an example illustrating multiple positioning possibilities of cylindrical, male coupling elements of another building element according to a nonstandard ½ BU offset coupling grid for the configuration 900. The male coupling elements of a 1×4 building element in a first position (corresponding to a standard 1BU coupling grid alignment) for coupling with the jumper plate 400 is shown by the solid line circles 970, 971, 972, and 973. A second position of the male coupling elements of the 1×4 building element (corresponding to a non-standard ½ BU coupling grid alignment) for coupling with the jumper plate 400 is shown by the dashed line circles 975, 976, 977, and 978. According to the second position, the location and alignment of the male coupling elements has shifted ½ BU in the x dimension.

Toy construction sets include a number of building elements of various types, for example, parts, pieces, and/or accessories, that may be assembled, disassembled, reassembled, and reconfigured countless times and in different configurations to provide hours of enjoyment, entertainment, and creative stimulation. The following description illustrates how the special building elements described above may be used in combination with other building elements in both standard and non-standard, fractional offset coupling alignments thereby providing additional options, designs, and creativity for builders.

Figure 10A:
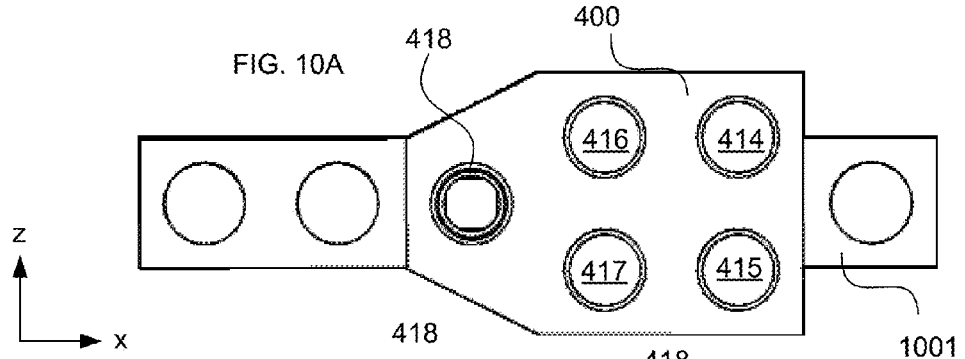
FIG. 10A is a top view of an example of a jumper plate combined with another building element.
Figure 10B:
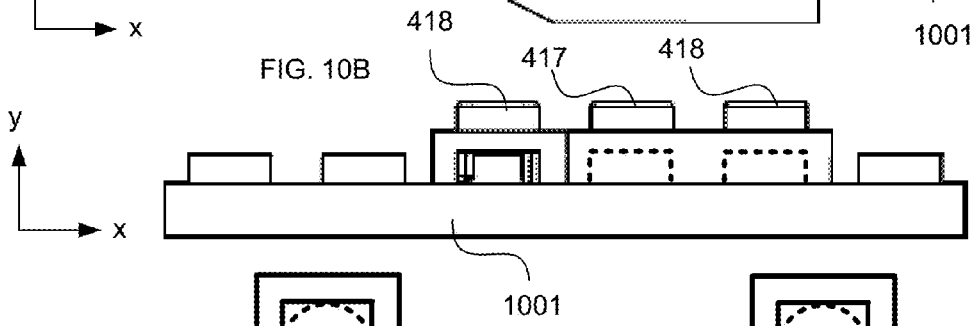
FIG. 10B is a side view of an example of a jumper plate combined with another building element.
Figure 10C:
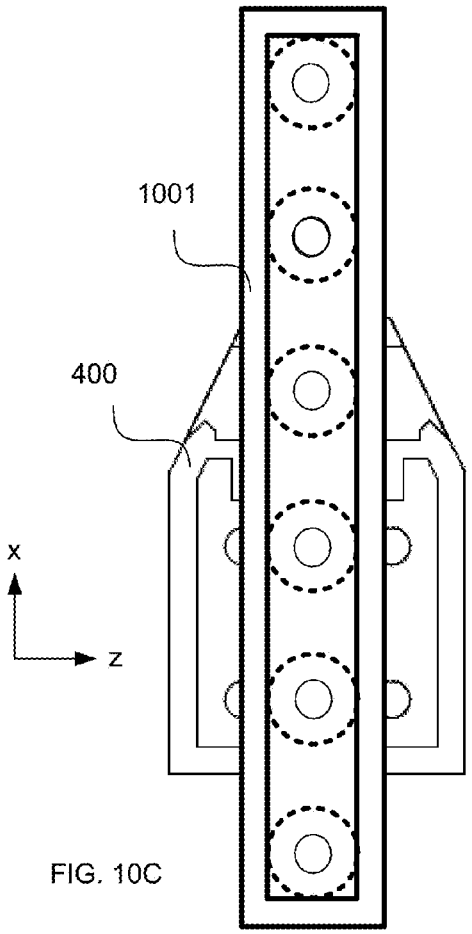
FIG. 10C is a bottom view of an example of a jumper plate combined with another building element illustrating an offset alignment.
Figure 10D:
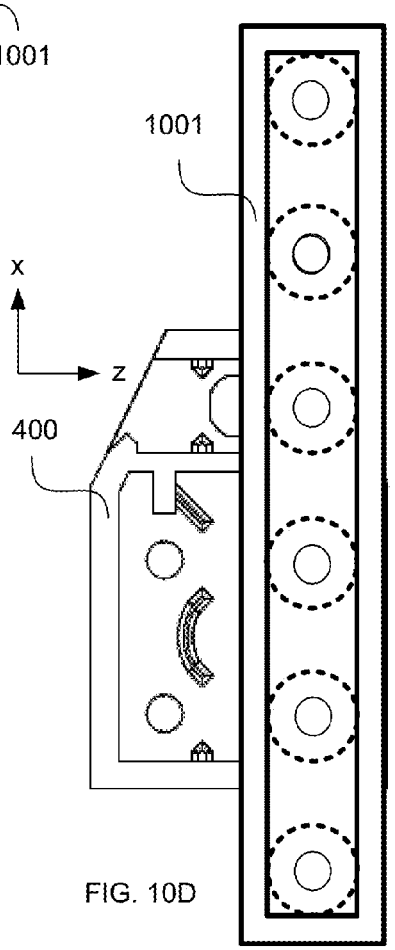
FIG. 10D is a top view of an example of a jumper plate combined with another building element illustrating a standard alignment.

FIG. 10A is a top view of an example of a jumper plate combined with another building element. FIG. 10B is a side view of the jumper plate combination of FIG. 10A. FIG. 10C is a bottom view of the jumper plate combination of FIGS. 10A and 10B. FIG. 10D is a bottom view of the jumper plate and building element of FIG. 10A combined in a different position.

FIGS. 10A-10D show a jumper plate 400 with underside 490 in configuration 900 combined with a 1×6 plate 1001. As shown in FIGS. 10A, 10B, and 10C, the third, fourth, and fifth male studs of the 1×6 plate 1001 are inserted in the female recesses of jumper plate 400 corresponding to stud positions 942, 954, and 955 shown in FIG. 9C. As shown in FIGS. 10A, 10B, and 10C, the studs of the 1×6 plate are offset by ½ BU in the z dimension from the studs 414, 415, 416, and 417 of the jumper plate 400. However, the third stud of the 1×6 plate 1001 is in 1BU alignment with stud 418 of the jumper plate 400 (as stud 418 is ½ BU offset in the z dimension from studs 414, 415, 416, and 417). In addition, as shown in FIG. 10B the third, fourth, and fifth studs of the 1×6 plate 1001 are aligned with the studs 414, 415, 416, and 417 in the x dimension.

FIG. 10D shows the jumper plate 400 with underside 490 in configuration 900 combined with the 1×6 plate 1001 in another position. As shown in FIG. 10D, the third, fourth, and fifth male studs of the 1×6 plate 1001 are inserted in the female recesses of jumper plate 400 corresponding to stud positions 943, 951, and 953 shown in FIG. 9C. In addition, the third, fourth and fifth male studs of the 1×6 plate are in 1BU alignment with the studs 415 and 417 of the jumper plate 400 in both the x and z dimensions and the third stud of the plate 1001 is ½ BU offset in the z dimension from stud 418 of the jumper plate 400.

Figure 10E:
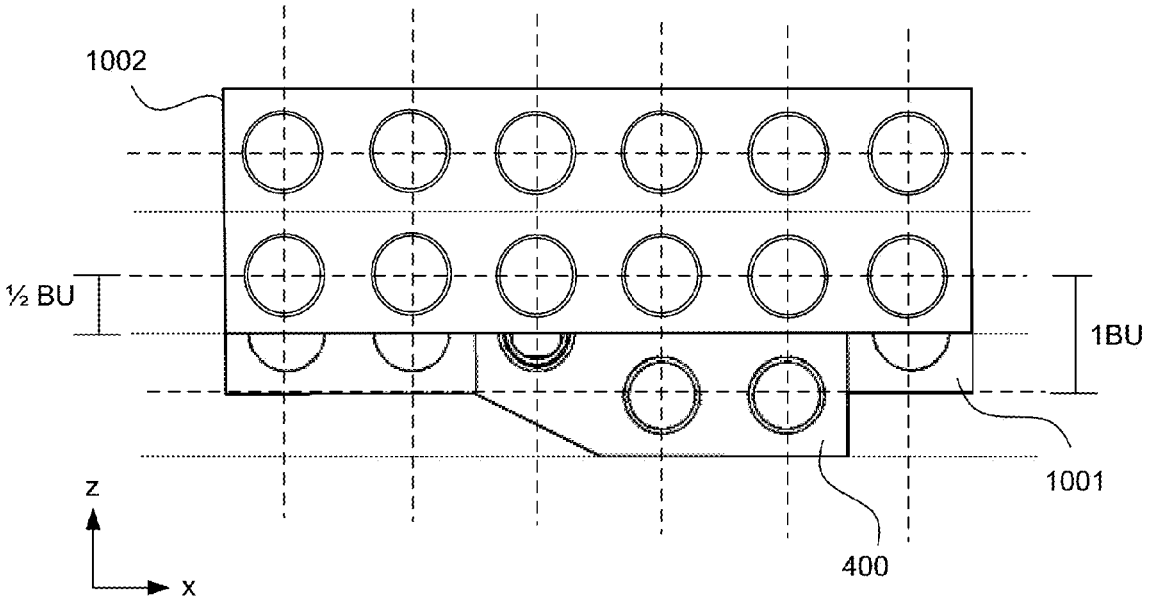
FIG. 10E is a top view of an example of a jumper plate combined with two other building elements to illustrate a standard and offset alignment.

FIG. 10E illustrates the combination of a set of building elements of a toy construction building set using the jumper plate to offset alignment between multiple building elements of the set.

FIG. 10E includes a set of at least three building elements: a jumper plate 400, a 1×6 plate 1001, and a 2×6 plate 1002. As shown in FIG. 10E, studs of the 1×6 plate 1001 are inserted in recesses of jumper plate 400 to combine building elements 1001 and 400 of the set. In addition, studs of jumper plate 400 are inserted in recesses of 2×6 plate 1002 to combine building elements 1002 and 400 resulting in a set of three combined building elements.

As shown in FIG. 10E, the 2×6 plate 1002 and jumper plate 400 are combined according to a standard 1BU coupling grid.

However, the 1×6 plate 1001 and jumper plate 400 are combined in an offset ½ BU coupling grid since the plate 1001 is offset by ½ BU in the z dimension while maintaining 1BU alignment in the x dimension. As a result of the combination of plates 1002 and 1001 using intermediary jumper plate 400 to facilitate the combination, the alignment between plate 1002 and plate 1001 is also offset by a ½ BU in the z dimension while maintaining 1BU alignment in the x dimension. Therefore, when used in combination with multiple other building elements of a toy construction set, the jumper plate 400 provides a designer more choices when combining building elements by allowing a designer to "jump" relative alignments in the z dimension, the x dimension, or both the x and z dimensions when using the jumper plate 400 in combination with multiple other building elements.

Figure 11A:
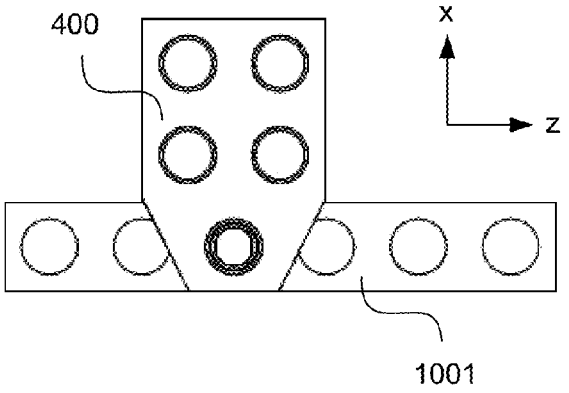
FIG. 11A is a top view of an example of a jumper plate combined with another building element in a standard alignment.
Figure 11B:
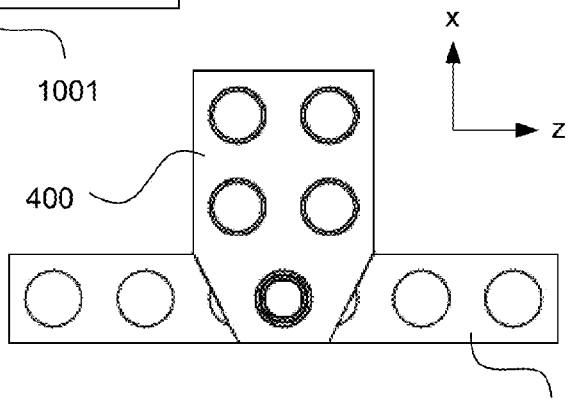
FIG. 11B is a top view of an example of a jumper plate combined with another building element in an offset alignment.
Figure 11C:
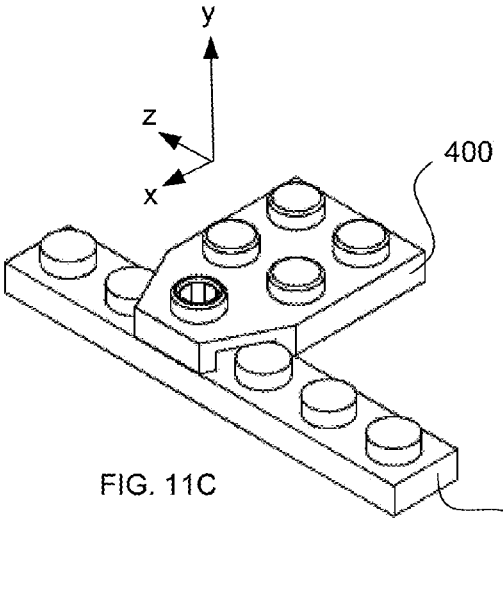
FIG. 11C is a top perspective view of the example shown in FIG. 11A.
Figure 11D:
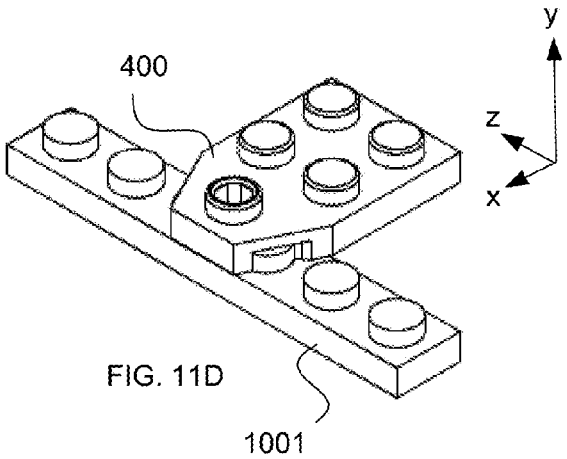
FIG. 11D is a top perspective view of the example shown in FIG. 11B.
Figure 11E:
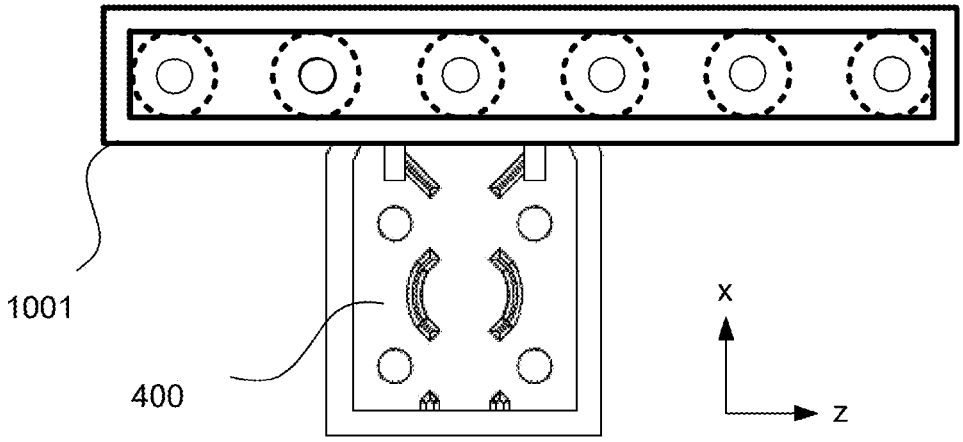
FIG. 11E is a bottom view of the example shown in FIGS. 11A and 11C.
Figure 11F:
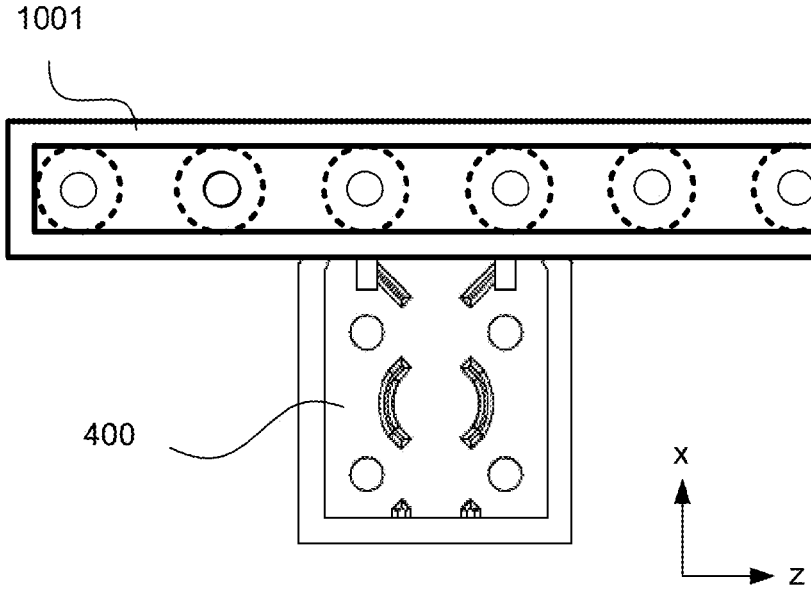
FIG. 11F is a bottom view of the example shown in FIGS. 11B and 11D.

FIGS. 11A-11E show various views of another orientation for the combination of the 1×6 plate 1001 and the jumper plate 400 along the z dimension of the tapered portion of the jumper plate 400. In these examples, studs of the plate 1001 are inserted in the recesses of the tapered portion 401 of the jumper plate 400. As shown in FIGS. 11A, 11C, and 11E, the alignment of the 1×6 plate 1001 and jumper plate 400 is shifted ½ BU in the z dimension to provide a non-standard offset ½ BU coupling alignment. As shown in FIGS. 11B, 11D, and 11F, the alignment of the 1×6 plate 1001 and jumper plate 400 is shifted ½ BU in the z dimension relative to FIGS. 11A, 11C, and 11E to provide a standard 1BU coupling alignment. Of note, the cutout portions 124 of the non-parallel walls 410 and 412 allow shifting of the 1×6 plate along the z dimension of the tapered portion in combination of the jumper plate 400 by removing any potential interference of the non-parallel walls 410 and 412 with the studs of the 1×6 plate.

Figure 11G:
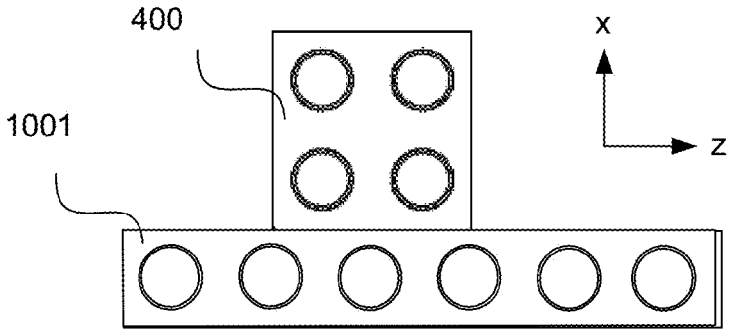
FIG. 11G is a top view of an example of a jumper plate combined with another building element in an offset alignment.

FIG. 11G shows an example of another orientation for the combination of the 1×6 plate 1001 and the jumper plate 400 along the z dimension of the tapered portion of the jumper plate 400. In this example, the stud 418 of the jumper plate 400 is inserted in a recess of the 1×6 plate 1001. As a result, the alignment of the 1×6 plate 1001 and jumper plate 400 is shifted ½ BU in the z dimension to provide a non-standard offset ½ BU coupling alignment relative to studs 414, 415, 416, and 417 and a standard 1BU coupling grid relative to stud 418.

Figure 12A:
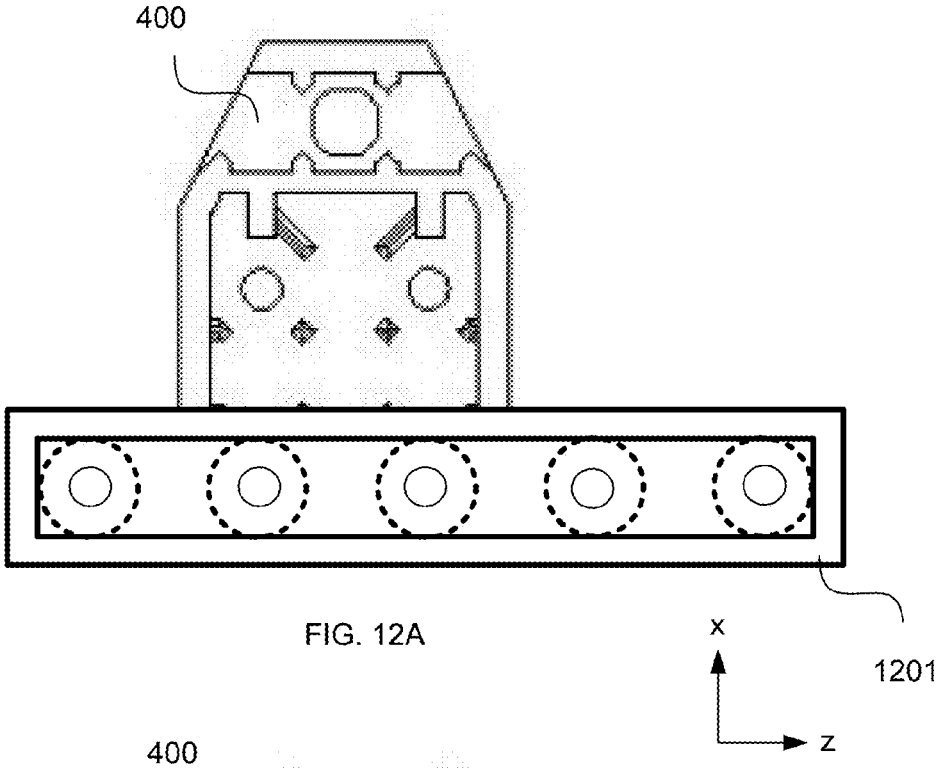
FIGS. 12A and 12B show examples of a bottom view a jumper plate combined with another building element contrasting standard and non-standard offset alignments.
Figure 12B:
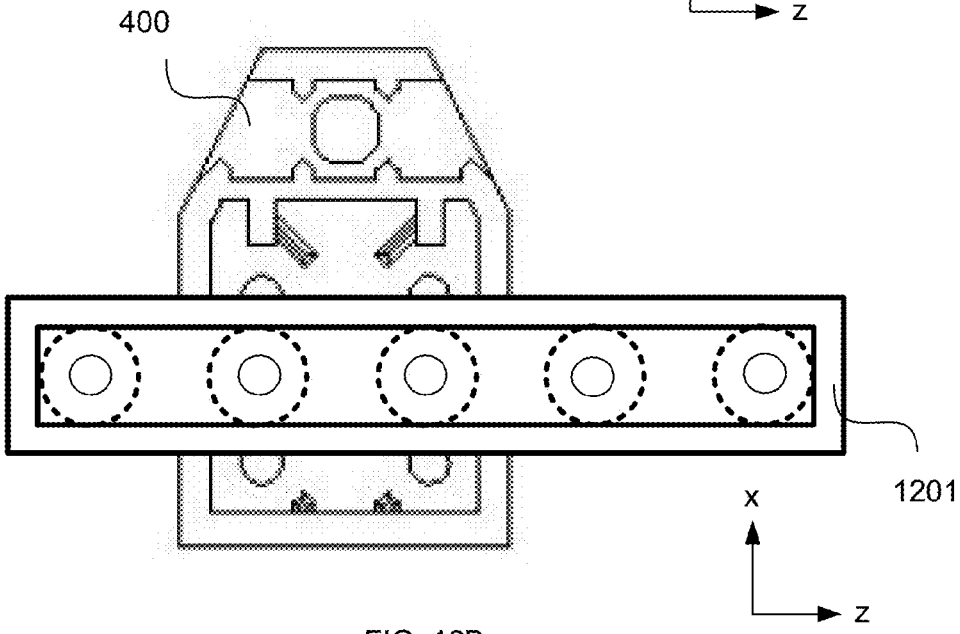

FIGS. 12A and 12B are bottom views of the combination of a jumper plate 400 combined with another building element illustrating standard and fractional offset alignments. As shown in FIGS. 12A and 12B, a jumper plate 400 with underside configuration 800 is combined with a 1×5 plate 1201. As shown in FIG. 12A, the second and third studs of plate 1201 are inserted in the stud positions 854 and 855 of jumper plate 400 shown in FIG. 8E resulting in a combination of the plates 400 and 1201 in a standard 1BU coupling alignment. As shown in FIG. 12B, the second and third studs of plate 1201 are inserted in the stud positions 852 and 853 of jumper plate 400 shown in FIG. 8E resulting in a combination of the plates 400 and 1201 where the 1×5 plate 1201 is offset by ½ a BU in the x dimension in a non standard ½ BU coupling alignment.

Figure 13:
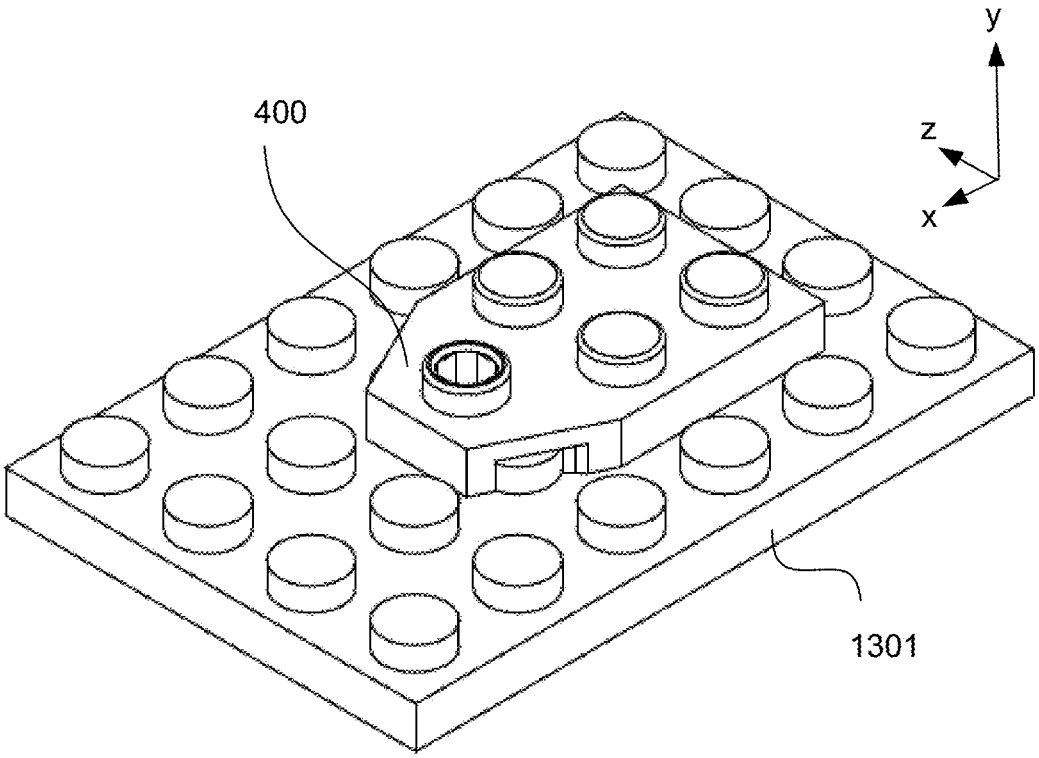
FIG. 13 is a top perspective view of an example of a jumper plate combined with another building element illustrating an standard alignment.

FIG. 13 is an upper perspective view of an example of a jumper plate 400 combined with another building element illustrating a standard alignment. As shown in FIG. 13, a jumper plate 400 with underside 490 in any of the configurations 500-900 is shown combined with a 4×6 plate. In this example, the 4×6 plate is combined with the jumper plate is a standard 1BU alignment. Of note, the cutout portions 124 of the non-parallel walls 410 and 412 allow combination of the jumper plate 400 with the 4×6 by removing any potential interference of the non-parallel walls 410 and 412 with the studs of the 4×6 plate.

Figure 14:
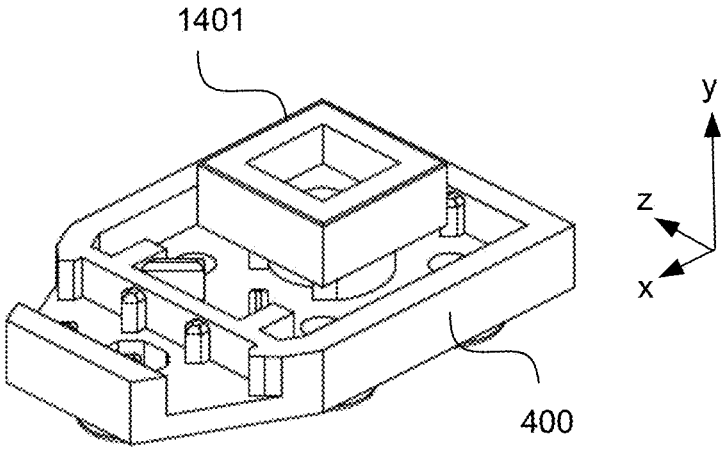
FIG. 14 is a bottom perspective view of an example of a jumper plate combined with another building element illustrating a offset alignment.

FIG. 14 is a bottom perspective view of an example of a jumper plate 400 combined with another building element illustrating an offset alignment. As shown in FIG. 14, the jumper plate 400 with underside 490 configuration 900 is combined with a 1×1 plate 1401. The one by one plate is located in the recess for stud position 956 as shown in FIG. 9C in a fractional offset coupling alignment. In this example, the 1×1 plate 1401 is fractional offset by ½ BU in both the z and x dimensions.

A number of exemplary implementations have been described. Nevertheless, it will be understood that various modifications may be made. Suitable results may be achieved if the steps of described techniques are performed in a different order and/or if components in a described components, architecture, or devices are combined in a different manner and/or replaced or supplemented by other components. Accordingly, other implementations are within the scope of the following claims.

What is claimed is:

1. A building element of a toy construction system, the building element comprising:

a first wall positioned in a first plane, the first wall comprising an inner surface and an outer surface;

a second wall extending orthogonally from the first wall;

a plurality of male coupling elements of a coupling size extending from the outer surface of the first wall, the male coupling elements arranged in a 1 building unit (BU) grid on the outer surface, the 1 BU grid comprising a plurality of 1 BU intersection points that coincide with the male coupling elements; and a plurality of female coupling elements arranged relative to the inner surface of the first wall in a fractional BU grid that comprises a plurality of fractional intersection points, the female coupling elements comprising open spaces of the coupling size, the fractional intersection points comprising points that coincide with the 1 BU intersection points and points that are offset from the 1 BU intersection points, each of the fractional intersection points coinciding with one of the plurality of female coupling elements, the fractional BU grid positioning a number of the plurality of female coupling elements to receive male coupling elements of another building element in alignment with the 1 BU grid of the plurality of male coupling elements and positioning a number of the plurality of female coupling elements to receive male coupling elements of another building element in a fractional alignment offset from the 1 BU grid of the plurality of male coupling elements in a single dimension of the first plane.

2. The building element of claim 1, wherein the fractional BU grid positions a number of the plurality of female coupling elements to receive multiple male coupling elements of another building element in a fractional alignment offset from the 1 BU grid of the plurality of male coupling elements in a single dimension of the first plane in either of a first dimension of the plane or a second dimension of the plane.

3. The building element of claim 1, wherein the fractional BU grid positions a number of the plurality of female coupling elements to receive multiple male coupling elements of another building element in a fractional alignment offset from the 1 BU grid of the plurality of male coupling elements in a single dimension of the first plane in either of a first dimension of the plane or a second dimension of the plane and simultaneously in both the first and the second dimensions of the first plane.

4. The building element of claim 1, wherein the points of the fractional BU grid that are offset from the 1 BU intersection points are offset by half of a distance between any two adjacent 1 BU intersection points.

5. The building element of claim 1, wherein the plurality of female coupling elements are arranged in at least one row and a plurality of columns, each row and column being half of a BU wide, a BU being a distance between any two adjacent 1 BU intersection points.

6. The building element of claim 1, wherein the plurality of female coupling elements are arranged in a plurality of rows and a plurality of columns, each row and column being half of a BU wide, a BU being a distance between any two adjacent 1 BU intersection points.

7. The building element of claim 1, further comprising grid elements, and wherein the open space of at least one of the plurality of female coupling elements is defined by at least two of the grid elements.

8. The building element of claim 7, wherein the grid elements are arranged in the fractional BU grid relative to the fractional intersection points.

9. The building element of claim 8, wherein the grid elements are half of a BU apart in two dimensions of the first plane, a BU being a distance between any two adjacent 1 BU intersection points.

10. The building element of claim 7, wherein the grid elements include at least one of a rib element, a post, and an end portion of a wall.

11. The building element of claim 1, further comprising grid elements, the open space of at least one of the female coupling elements being defined by at least two grid elements and wherein the grid elements comprise at least one rib element formed on an interior side of the second wall.

12. The building element of claim 1, further comprising grid elements, wherein the open space of at least one female coupling element of the plurality of female coupling elements is defined by at least two of the grid elements, and the grid elements comprise a plurality of rib elements formed on at least two interior sides of the second wall.

13. The building element of claim 1, further comprising grid elements, wherein the open space of at least one female coupling element of the plurality of female coupling elements is defined by at least two of the grid elements, and the grid elements comprise a post that extends orthogonally from the inner surface.

14. The building element of claim 1, further comprising grid elements, wherein the open space of at least one female coupling element of the plurality of female coupling elements is defined by at least two of the grid elements, the grid elements comprising at least four posts that extend orthogonally from the inner surface of the first wall.

15. The building element of claim 1, further comprising grid elements, wherein the open space of at least one female coupling element of the plurality of female coupling elements is defined by at least two of the grid elements, the grid elements comprising an end portion of a wall.

16. The building element of claim 15, wherein the end portion of a wall comprises an end portion of the second wall.

17. The building element of claim 15, wherein the end portion of a wall comprises an end portion of a wall other than the first wall and the second wall, the wall extending from the inner surface of the first wall in a direction that is different from a direction in which the male coupling elements extend from the outer surface of the first wall.

18. The building element of claim 1, wherein the male coupling element is a cylindrical stud.

19. The building element of claim 1 further comprising another male coupling element of the coupling size extending from the outer surface of the first wall, wherein the other male coupling element is arranged relative to the male coupling elements according to a fractional BU grid, and the other male coupling element is fractionally offset from any of the male coupling elements in at least a single dimension of the first plane.

20. The building element of claim 1, wherein the 1 BU grid is an arrangement of the plurality of male coupling elements in one or more rows and columns, the one or more rows are parallel to a first dimension in the first plane, and the one or more columns are parallel to a second dimension in the first plane, and the centers of any two adjacent male coupling elements of the arrangement in any one dimension are 1 BU apart.

21. The building element of claim 1, further comprising grid elements, and wherein the open space of at least one of the plurality of female coupling elements is defined by at least two of the grid elements, the grid elements comprising at least one element that extends from the inner surface of the first wall.

22. The building element of claim 21, wherein the at least one grid element that extends from the inner surface of the first wall comprises a plurality of discrete elements that do not touch each other.

23. The building element of claim 1, further comprising grid elements, and wherein the open space of at least one of the plurality of female coupling elements is defined by at least two of the grid elements, the grid elements comprising a portion of the second wall.

24. The building element of claim 1, further comprising grid elements, the grid elements comprising a portion of the second wall, and wherein the open space of at least one of the plurality of female coupling elements is defined by at least two grid elements.

25. The building element of claim 1, further comprising grid elements, and wherein the second wall is along a perimeter of the first wall, and the grid elements comprise a plurality of corners formed by an inner surface of the second wall and a plurality of ribs that extend from the inner surface of the second wall, and the open space of any of the female coupling elements is defined by two of the corners and two of the ribs or defined by four of the ribs.

26. The building element of claim 25, wherein the fractional BU grid comprises a single row and a plurality of columns.

27. The building element of claim 1, further comprising grid elements, and wherein the open space of at least one of the female coupling elements is defined by at least two grid elements, and the grid elements comprise a rib that extends from the second wall.

28. A toy building set comprising:

a plurality of building elements, the building elements comprising male coupling elements of a coupling size and female coupling elements, the male and female coupling elements arranged in a 1 building unit (BU) grid; and an adapter building element including:

a plurality of male coupling elements of the coupling size extending from an outer surface of the adapter building element, the male coupling elements arranged in a 1 BU grid on a plane the outer surface; and a plurality of female coupling elements arranged in the building element in a fractional BU grid that comprises a plurality of fractional BU intersection points, the fractional BU intersection points comprising points that correspond to the 1 BU grid and points that are offset from the 1 BU grid, the female coupling elements comprising an open space of the coupling size, each fractional BU intersection point coinciding with one of the female coupling elements, the fractional BU grid positioning one or more of the plurality of female coupling elements to receive male coupling elements of another building element in alignment with the 1 BU grid of the plurality of male coupling elements and positioning one or more of the plurality of female coupling elements to receive male coupling elements of another building element in a fractional alignment offset from the 1 BU grid of the plurality of male coupling elements in a single dimension corresponding to the plane of the outer surface.

29. The toy building set of claim 28, wherein the adapter building element, when coupled to one or more female coupling elements of a first one of the plurality of building elements and simultaneously coupled to one or male coupling of a second one of the plurality of building elements, offsets the 1BU grid of the first one of the plurality of building elements from the 1BU grid of the second one of the plurality of building elements by a fraction of a BU in a single dimension corresponding to the plane of the outer surface of the adapter building element.

30. The building element of claim 28, wherein the adapter building element further comprises:

a second wall, the second wall extending from a perimeter of the outer surface in a direction that is different from a direction along which the plurality of male couplings extend, and grid elements that comprise a plurality of corners formed by an inner surface of the second wall and a plurality of ribs that extend from the inner surface of the second wall, and the open space of any of the female coupling elements is defined by two of the corners and two of the ribs or defined by four of the ribs.

31. A toy building set comprising a plurality of toy building elements, wherein the plurality of toy building elements comprise an adapter building element, the adapter building element comprising:

a first wall positioned in a first plane, the first wall comprising an inner surface and an outer surface;

a second wall extending orthogonally from the first wall;

a plurality of male coupling elements of a first coupling size extending from the outer surface of the first wall, the male coupling elements arranged in a 1 building unit (BU) grid on the outer surface; and a plurality of female coupling elements of the first coupling size arranged in a fractional BU grid that comprises a plurality of fractional BU intersection points, the fractional BU intersection points comprising points that correspond to the 1 BU grid and points that are offset from the 1 BU grid, the female coupling elements comprising an open space of the coupling size, each fractional BU intersection point coinciding with one of the female coupling elements, the fractional BU grid positioning a number of the plurality of female coupling elements to receive multiple male coupling elements of another building element in alignment with the 1 BU grid of the plurality of male coupling elements and positioning a number of the plurality of female coupling elements to receive multiple male coupling elements of another building element in a fractional alignment offset from the 1 BU grid of the plurality of male coupling elements in a single dimension of the first plane.

32. The building element of claim 31, further comprising grid elements, and wherein the second wall extends from a perimeter of the outer surface of the first wall in a direction that is different from a direction along which the plurality of male couplings extend, and the grid elements comprise a plurality of corners formed by an inner surface of the second wall and a plurality of ribs that extend from the inner surface of the second wall, and the open space of any of the female coupling elements is defined by two of the corners and two of the ribs or defined by four of the ribs.

* * * * *